US009310731B2

(12) United States Patent
Yonekubo et al.

(10) Patent No.: US 9,310,731 B2
(45) Date of Patent: Apr. 12, 2016

(54) IMAGE HEATING APPARATUS

(71) Applicant: CANON KABUSHIKI KAISHA, Tokyo (JP)

(72) Inventors: Hideaki Yonekubo, Suntou-gun (JP); Tomonori Sato, Gotemba (JP); Shizuma Nishimura, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/855,183

(22) Filed: Sep. 15, 2015

(65) Prior Publication Data

US 2016/0004198 A1 Jan. 7, 2016

Related U.S. Application Data

(63) Continuation of application No. 14/568,872, filed on Dec. 12, 2014, now Pat. No. 9,176,441.

(30) Foreign Application Priority Data

Dec. 18, 2013 (JP) ..... 2013-261513
Dec. 18, 2013 (JP) ..... 2013-261518

(51) Int. Cl.
*G03G 15/20* (2006.01)

(52) U.S. Cl.
CPC ..... *G03G 15/2057* (2013.01); *G03G 15/2053* (2013.01)

(58) Field of Classification Search
CPC ..... G03G 15/2053
See application file for complete search history.

*Primary Examiner* — G. M. Hyder
(74) *Attorney, Agent, or Firm* — Canon USA, Inc. IP Division

(57) ABSTRACT

An image heating apparatus, to heat an image formed on a recording material includes a cylindrical rotatable member having a conductive layer, a coil having a helically shaped portion which is helically wound in a generatrix direction of the rotatable member inside the rotatable member, and a magnetic core disposed inside the helically shaped portion. The coil, which includes a number of turns, produces an alternating magnetic field to cause the conductive layer to generate heat by electromagnetic induction. The magnetic core includes a plurality of divided cores into which the magnetic core is divided in the generatrix direction. The number of turns of the coil per unit length, at a region that corresponds to a boundary between the plurality of divided cores, is larger than the number of turns of the coil at a region that corresponds to the plurality of divided cores.

15 Claims, 31 Drawing Sheets

WHEN SLEEVE (CONDUCTIVE LAYER) IS NOT MOUNTED

WHEN SLEEVE (CONDUCTIVE LAYER) IS MOUNTED

EQUIVALENTLY CONVERTED INTO T-TYPE $a_1$: RADIUS OF MAGNETIC CORE 2
$a_2$: INNER DIAMETER OF CONDUCTIVE LAYER
$a_3$: OUTER DIAMETER OF CONDUCTIVE LAYER
$\mu_0$: MAGNETIC PERMEABILITY OF AIR
$\mu_1$: MAGNETIC PERMEABILITY OF MAGNETIC CORE 2
$\mu_2$: MAGNETIC PERMEABILITY OF CONDUCTIVE LAYER

CROSS-SECTIONAL VIEW OF REGION 1 OR 3

CROSS-SECTIONAL VIEW OF REGION 2

EXEMPLARY EMBODIMENT

COMPARATIVE EXAMPLE 3

COMPARATIVE EXAMPLE 4

CENTRAL POSITION OF FIXING SLEEVE
(CENTRAL POSITION OF RECORDING MATERIAL
IN DIRECTION PERPENDICULAR TO RECORDING
MATERIAL CONVEYANCE DIRECTION)

IMAGE HEATING APPARATUS

CROSS REFERENCE TO RELATED APPLICATIONS

The present application is a continuation of U.S. patent application Ser. No. 14/568,872, filed on Dec. 12, 2014, which claims priority from Japanese Patent Application No. 2013-261513, filed Dec. 18, 2013, and from Japanese Patent Application No. 2013-261518, filed Dec. 18, 2013, all of which are hereby incorporated by reference herein in their entirety.

BACKGROUND

1. Field of the Invention

The present disclosure relates to an image heating apparatus mounted on an electrophotographic image forming apparatus such as a copying machine and a printer.

2. Description of the Related Art

Generally, an image heating apparatus mounted on an electrophotographic image forming apparatus such as a copying machine and a printer heats a toner image formed on a recording material while conveying the recording material bearing the unfixed toner image at a nip portion formed by a rotatable member and a pressure roller in pressure contact with the rotatable member.

In recent years, there has been proposed an image heating apparatus according to the electromagnetic induction heating method that allows a conductive layer included in the rotatable member to directly generate heat. This image heating apparatus according to the electromagnetic induction heating method has advantages of being able to warm up in a short time, and consuming only low power. Japanese Patent Application Laid-Open No. 2004-61998 discusses a fixing apparatus that includes a rotatable member containing therein an exciting coil and a magnetic core divided into a plurality of pieces, and supplies a current to the coil to produce an alternative magnetic field to thereby cause the rotatable member to generate heat by Joule heat derived from an eddy current flowing on the rotatable member.

However, when a plurality of magnetic cores is arranged in a generatrix direction of the rotatable member, like Japanese Patent Application Laid-Open No. 2004-61998, in the rotatable member, an amount of generated heat may be reduced at a position of the rotatable member corresponding to a division region between the magnetic cores to generate uneven heat, causing an image defect.

SUMMARY

According to a first aspect of the present invention, an image heating apparatus configured to heat an image formed on a recording material includes a cylindrical rotatable member including a conductive layer, a coil including a helically shaped portion which is helically wound in a generatrix direction of the rotatable member inside the rotatable member, wherein the coil includes a number of turns and is configured to produce an alternating magnetic field for causing the conductive layer to generate heat by electromagnetic induction, and a magnetic core disposed inside the helically shaped portion, wherein the magnetic core includes a plurality of divided cores into which the magnetic core is divided in the generatrix direction, and wherein the number of turns of the coil per unit length, at a region that corresponds to a boundary between the plurality of divided cores, is larger than the number of turns of the coil at a region that corresponds to the plurality of divided cores.

According to a second aspect of the present disclosure, an image heating apparatus, which is configured to heat an image formed on a recording material, includes a cylindrical rotatable member including a conductive layer, and a coil including a helically shaped portion which is helically wound along a generatrix direction of the rotatable member inside the rotatable member. The coil is configured to produce an alternating magnetic field for causing the conductive layer to generate heat by electromagnetic induction. The image heating apparatus further includes a magnetic core disposed inside the helically shaped portion. The magnetic core is shaped so as not to form a loop outside the rotatable member. The magnetic core includes divided cores in which the magnetic core is divided into two pieces having equal lengths in the generatrix direction. A position of a boundary between the divided cores is substantially coinciding with a central position of the rotatable member in the generatrix direction.

According to a third aspect of the present disclosure, an image heating apparatus, which is configured to heat an image formed on a recording material, includes a cylindrical rotatable member including a conductive layer, and a coil including a helically shaped portion which is helically wound in a generatrix direction of the rotatable member inside the rotatable member. The coil is configured to produce an alternating magnetic field for causing the conductive layer to generate heat by electromagnetic induction. The image heating apparatus further includes a magnetic core disposed inside the helically shaped portion. The magnetic core is shaped so as not to form a loop outside the rotatable member. The magnetic core includes divided cores in which the magnetic core is divided into two pieces having equal lengths in the generatrix direction. A position of a boundary between the divided cores is substantially coinciding with a central position of a region of the rotatable member which the recording material passes through, with respect to the generatrix direction.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

1. General Description of Image Forming Apparatus

Figure 1:
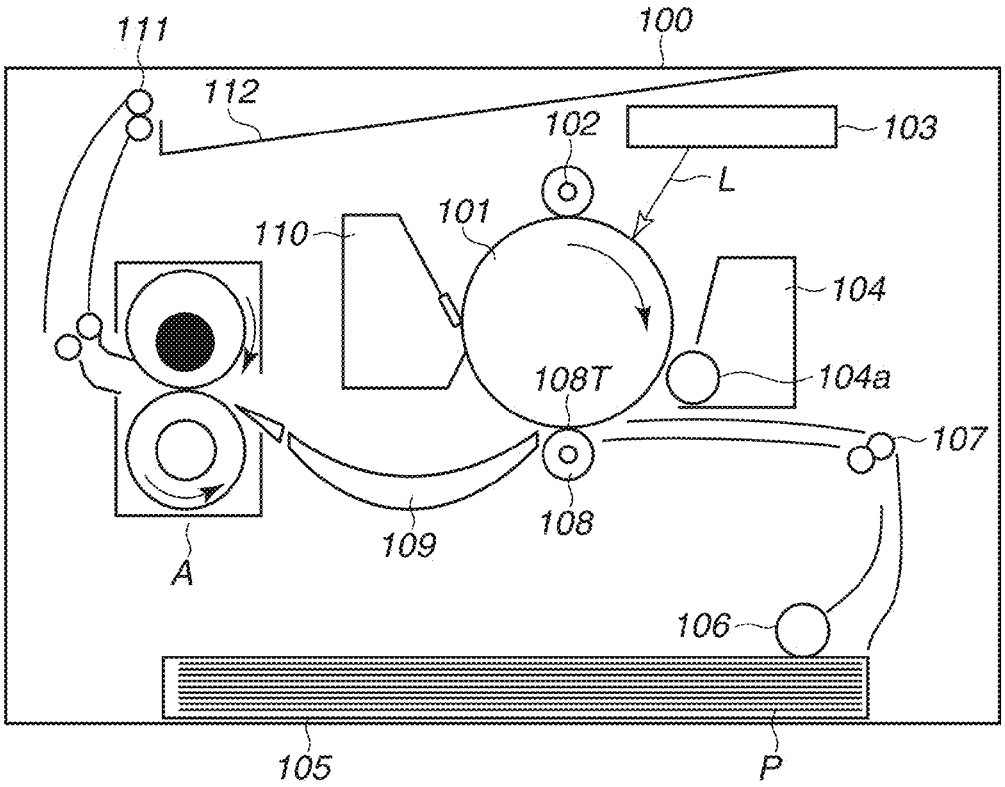
FIG. 1 illustrates an overview of an image forming apparatus.

FIG. 1 illustrates an overview of a configuration of an image forming apparatus 100 according to a first exemplary embodiment. The image forming apparatus 100 is an electrophotographic laser beam printer. A photosensitive drum 101 works as an image bearing member, and is rotationally driven at a predetermined process speed (a circumferential speed) in the clockwise direction indicated by an arrow. The photosensitive drum 101 is evenly charged so as to have a predetermined polarity and a predetermined electric potential by a charging roller 102 during this rotation process. A laser beam scanner 103 works as an image exposure unit. The scanner 103 outputs laser light L which is on-off-modulated according to a digital image signal input from a not-illustrated external apparatus such as a computer and generated by an image processing unit, to scan and expose a charged surface of the photosensitive drum 101. Electric charges are removed from an exposed bright portion on the surface of the photosensitive drum 101 by this scanning and exposure, whereby an electrostatic latent image corresponding to the image signal is formed on the surface of the photosensitive drum 101. A development device 104 supplies a developer (toner) from a development roller 104*a* onto the surface of the photosensitive drum 101. Consequently, the electrostatic latent image formed on the surface of the photosensitive drum 101 is sequentially developed as a toner image, which is a transferable image. A sheet feeding cassette 105 contains recording materials P in a stacked state. A sheet feeding roller 106 is driven based on a sheet feeding start signal, and the recording materials P contained in the sheet feeding cassette 105 are separated and are fed one by one. Then, the recording material P is guided at a predetermined timing via a registration roller pair 107 to a transfer portion 108T, which is an abutment nip portion between the photosensitive drum 1 and a transfer roller 108. The photosensitive drum 1 and a transfer roller 108 rotate driven in contact with the photosensitive drum 1. In other words, the conveyance of the recording material P is controlled by the registration rollers 107 in such a manner that a leading edge of the toner image on the photosensitive drum 101 and a leading edge of the recording material P reach the transfer portion 108T at the same time. After that, the recording material P is conveyed through the transfer portion 108T while being sandwiched by the transfer portion 108T, during which a transfer voltage (a transfer bias) controlled in a predetermined manner is applied from a transfer bias application power source (not illustrated) to the transfer roller 108. The transfer bias having a polarity opposite to the toner is applied to the transfer roller 108, and the toner image on the surface side of the photosensitive drum 1 is electrostatically transferred onto a surface of the recording material P at the transfer portion 108T. The recording material P after the transfer is separated from the surface of the photosensitive drum 1, is conveyed through a conveyance guide 109, and is guided into a fixing apparatus A. The toner image is subjected to a heat-fixing process at the fixing apparatus A. On the other hand, after transferring the toner image onto the recording material P, remaining toner after the transfer, paper powder, and the like are removed from the surface of the photosensitive drum 1 by a cleaning device 110 to clean a surface, which is repeatedly used in image formation. The recording material P after passing through the fixing apparatus A is discharged onto a sheet discharge tray 112 via a discharge port 111.

2. General Description of Fixing Apparatus

Figure 2:
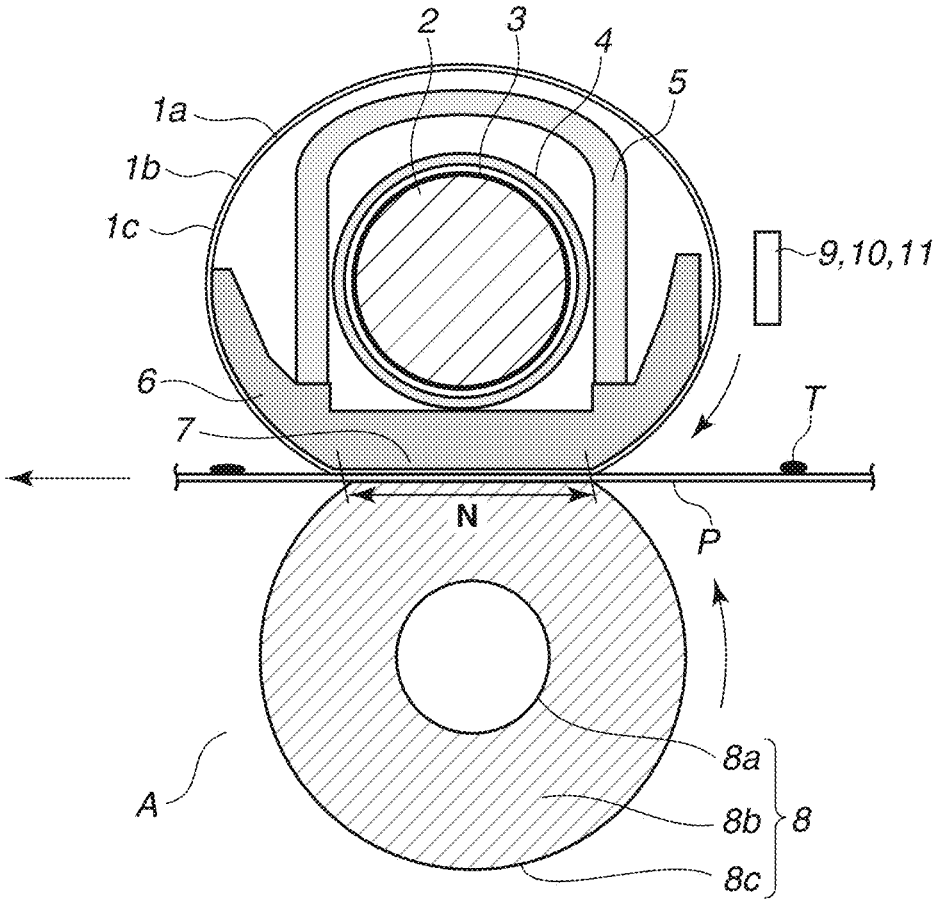
FIG. 2 is a cross-sectional view of a fixing apparatus.
Figure 3:
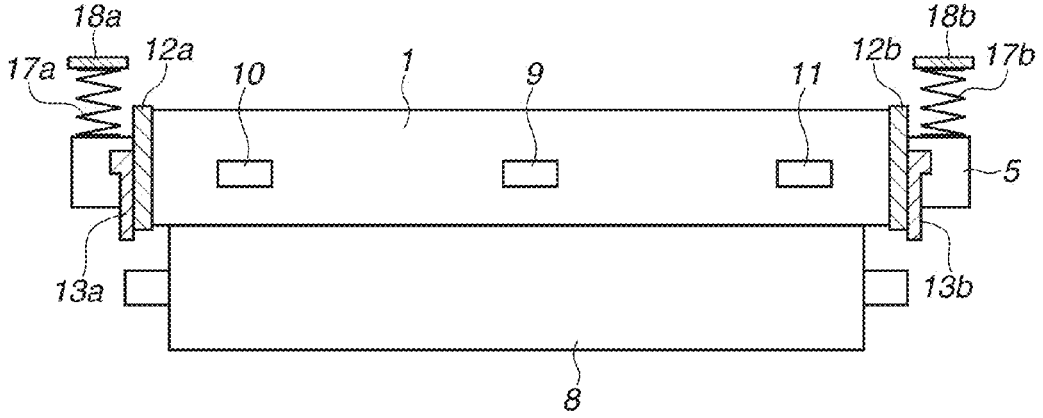
FIG. 3 is a front view of the fixing apparatus.
Figure 4:
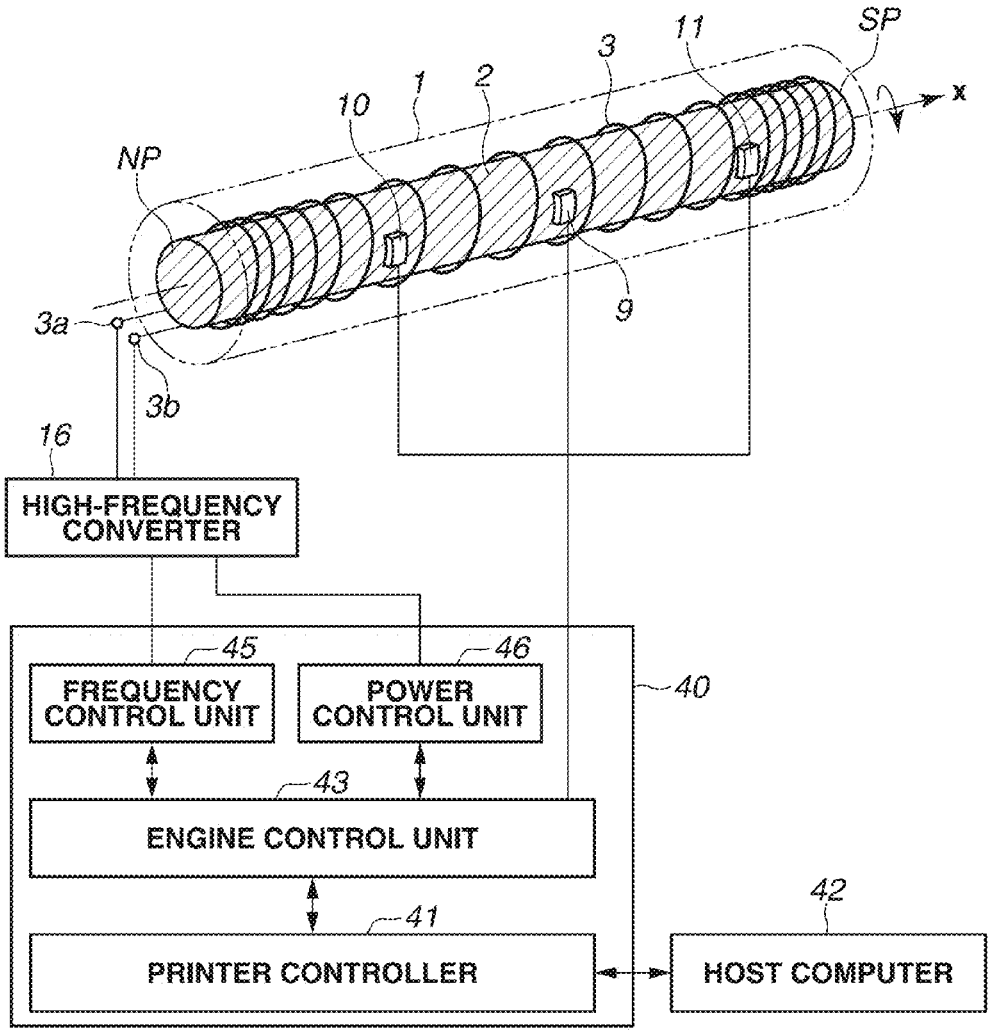
FIG. 4 is a perspective view of the fixing apparatus.

The fixing apparatus A as an image heating apparatus according to the first exemplary embodiment employs the electromagnetic induction heating method. FIG. 2 is a cross-sectional view illustrating main portions of the fixing apparatus A according to the first exemplary embodiment. FIG. 3 is a front view illustrating the main portions of the fixing apparatus A according to the first exemplary embodiment. FIG. 4 is a perspective view illustrating the main portions of the fixing apparatus A according to the first exemplary embodiment. A pressure roller 8 as a counter member includes a core metal 8*a*, a heat-resistant elastic material layer 8*b* formed around the core metal 8*a*, and a release layer 8*c* as a surface layer. The elastic layer 8*b* can be made from a highly heat-resistant material such as silicon rubber, fluorine-contained rubber, and fluorosilicone rubber. Both ends of the core metal 8*a* are arranged so as to be rotatably held between chassis-side sheet metals (not illustrated) of the apparatus via conductive bearings. Further, pressure springs 17*a* and 17*b* are disposed between both ends of a pressure stay 5 and spring bearing members 18*a* and 18*b* on the apparatus chassis side illustrated in FIG. 3, respectively, by which a push-down force is applied to the pressure stay 5. At the fixing apparatus A according to the present exemplary embodiment, a pressing force of approximately 100 N to 250 N (approximately 10 kgf to 25 kgf) is applied in total to the pressure stay 5.

A nip portion formation member 6 forms a fixing nip portion N together with the pressure roller 8 via a fixing sleeve 1 in contact with an inner surface of the fixing sleeve 1. The nip portion formation member 6 is made from Polyphenylenesulfide (PPS) which is heat-resistant resin, or the like, and is also configured to guide the inner surface of the fixing sleeve 1. The pressure roller 8 is rotationally driven by a not-illustrated driving source in the counterclockwise direction indicated by an arrow, and a rotating force is applied to the fixing sleeve 1 by frictional force against an outer surface of the fixing sleeve 1. Flange members 12*a* and 12*b* are externally fitted to both ends of the nip portion formation member 6 on the left side and the right side. Positions of these flange members 12*a* and 12*b* in a generatrix direction of the fixing sleeve 1 are fixed by regulating members 13*a* and 13*b*. The flange members 12*a* and 12*b* regulate a movement of the fixing sleeve 1 in the generatrix direction of the fixing sleeve 1 by contacting end portions of the fixing sleeve 1, when the fixing sleeve 1 rotates. The flange members 12*a* and 12*b* can be each made from a highly heat-resistant material such as liquid crystal polymer (LCP) resin.

The fixing sleeve 1 as a rotatable member includes a heat generation layer (a conductive layer) 1*a* as a base layer, an elastic layer 1*b* formed on the outer side of the base layer, and a release layer 1*c* formed on the outer side of the elastic layer 1*b*. The fixing sleeve 1 has a diameter (an outer diameter) of 10 to 50 mm. Further, the heat generation layer 1*a* is a metallic film having a thickness of 10 to 50 μm. Desirably, the heat generation layer 1*a* is made from non-magnetic metal (a non-magnetic material). More specifically, desirably, the heat generation layer 1*a* is made from at least one of silver, aluminum, austenite stainless steel, and copper. The elastic layer 1*b* is a layer made of a silicon rubber having a hardness of 20 degrees (Japanese Industrial Standards (JIS)-A, under a weight of one kg) and a thickness of 0.1 to 0.3 mm. The elastic layer 1*b* has a length of 260 mm in the generatrix direction of the rotatable member. The release layer 1*c* is made of a fluorine-contained resin tube having a thickness of 50 μm to 10 μm. This heat generation layer 1*a* generates heat owing to electromagnetic induction when being subjected to an alternating magnetic flux. Heat derived from this heat of the heat generation layer 1*a* is transmitted to the elastic layer 1*b* and the release layer 1*c*, thereby heating the entire fixing sleeve 1 to heat the recording material P conveyed through the fixing nip portion N to fix a toner image T.

A mechanism for applying the alternating magnetic flux to the heat generation layer 1*a* to generate an induced current will be described now. FIG. 4 is the perspective view of the fixing apparatus A. An exciting coil 3 is disposed inside the fixing sleeve 1, wound so as to form a helically shaped portion having a helix axis substantially in parallel with the generatrix direction of the fixing sleeve 1 to produce an alternating magnetic field. The alternating magnetic field changes its magnitude and direction repeatedly with time. A magnetic core 2 as a magnetic core member is disposed inside the helically shaped portion, and guides a line of magnetic force of the alternating magnetic field to form a magnetic path of the magnetic line. A linear open magnetic path having the magnetic poles North Pole (NP) and South Pole (SP) is formed. A high-frequency current is supplied via power supply contact portions 3*a* and 3*b* of the exciting coil 3 with use of a high-frequency converter or the like, by which a magnetic flux is produced within the magnetic core 2.

2-1) Heat Generation Mechanism of Fixing Apparatus

A heat generation mechanism of the fixing apparatus A according to the present exemplary embodiment will be described now with reference to FIG. 20A. Lines of magnetic force produced due to supply of an alternating current to the exciting coil 3 pass through an inside of the magnetic core 2 inside the cylindrical conductive layer 1*a* in the generatrix direction of the conductive layer 1*a* (a direction from S toward N), and exit out of the conductive layer 1*a* via one end (N) of the magnetic core 2 to return to the other end (S) of the magnetic core 2. As a result, an induced electromotive force that generates lines of magnetic force in a direction opposing an increase and decrease of a magnetic flux passing through the inside of the conductive layer 1*a* in the generatrix direction of the conductive layer 1*a* is produced on the conductive layer 1*a*, and a current is induced in a circumferential direction of the conductive layer 1*a*. The conductive layer 1*a* generates heat by Joule heat derived from this induced current. A magnitude of this induced electromotive force V produced on the conductive layer 1*a* is proportional to a change amount of the magnetic flux passing through the inside of the conductive layer 1*a* per unit time (Δϕ/Δt), and the number of turns of the coil 3 according to a following expression 1.

$$V = -N\frac{\Delta\varphi}{\Delta t} \tag{1}$$

Figure 20A:
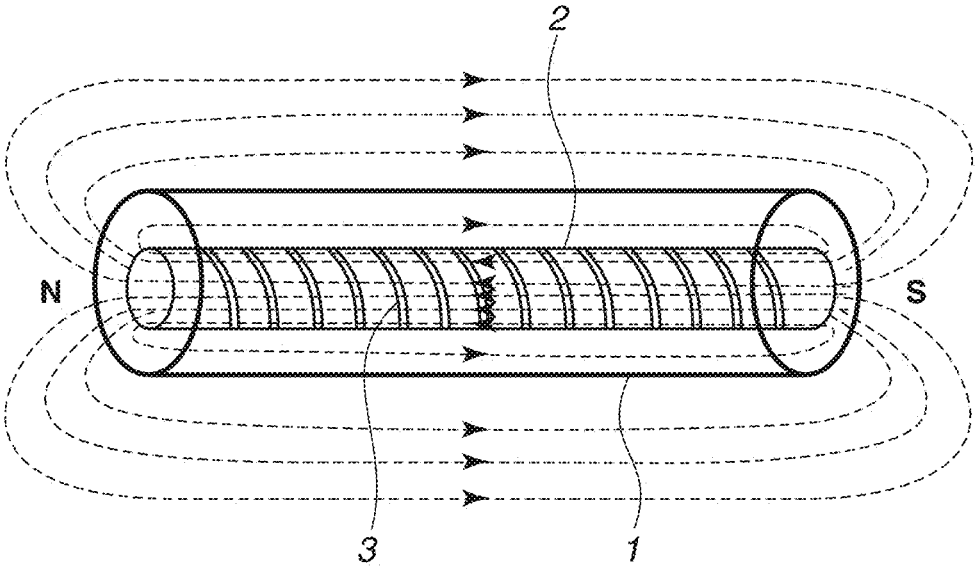
FIGS. 20A and 20B illustrate a heat generation mechanism.
Figure 20B:
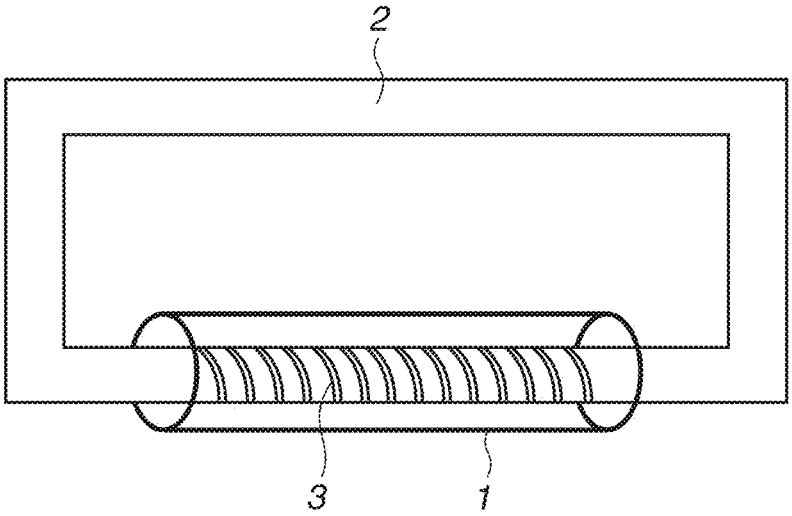

2-2) Relationship Between Rate of Magnetic Flux Passing Through Outside of Conductive Layer and Power Conversion Efficiency The magnetic core 2 illustrated in FIG. 20A is shaped to have end portions without forming a loop. In a fixing apparatus configured in such a manner that the magnetic core 2 forms a loop outside the conductive layer 1*a* as illustrated in FIG. 20B, the line of magnetic force exits out of the conductive layer 1*a* and returns into the conductive layer 1*a*, guided by the magnetic core 2. However, if the magnetic core 2 is configured to have end portions, like the present exemplary embodiment, there is nothing to guide the line of magnetic force that exits from the end of the magnetic core 2. Therefore, there are two possibilities for routes of the magnetic lines. Namely, the magnetic line returning to the other end of the magnetic core 2 after exiting from the one end of the magnetic core 2 (from N to S) may take an external route passing through the outside of the conductive layer 1*a*, or an internal route passing through the inside of the conductive layer 1*a*. Hereinafter, the term "external route" will be used to refer to the route going from N to S of the magnetic core 2 through the outside of the conductive layer 1*a*, and the term "internal route" will be used to refer to the route going from N to S of the magnetic core 2 through the inside of the conductive layer 1*a*.

A ratio of lines of magnetic force passing through the external route, of the magnetic lines exiting from the one end of the magnetic core 2 is correlated to power consumed when the heat is generated in the conductive layer 1*a* by power supplied to the coil 3 (power conversion efficiency), and is an important parameter. As the ratio of the of magnetic lines passing through the external route increases, a ratio of power consumed by the heat generation in the conductive layer 1*a*, to the power supplied to the coil 3 (the power conversion efficiency) increases. A principle of this reason is similar to a principle that the power conversion efficiency increases, if a leakage flux is sufficiently small in a transformer, and the number of lines of magnetic force passing through a primary winding of the transformer is equal to the number of lines of magnetic force passing through a secondary winding of the transformer. In other words, in the present exemplary embodiment, as the number of lines of magnetic force passing through the inside of the magnetic core 2 gets closer to the number of lines of magnetic force passing through the external route, the power conversion efficiency increases, and the high-frequency current supplied to the coil 3 can be more efficiently used as a loop current in the conductive layer 1*a* for electromagnetic induction.

Because lines of magnetic force passing through the inside of the magnetic core 2 from S to N, which are illustrated in FIG. 20A, and the lines of magnetic force passing through the internal route have opposing directions, these lines of magnetic force are canceled out by each other in the inside of the conductive layer 1*a* as a whole including the magnetic core 2. This results in decrease in the number of lines of magnetic force (the magnetic flux) passing through the entire inside of the conductive layer 1*a* from S to N, which leads to decrease in the change amount of the magnetic flux per unit time. The decrease in the change amount of the magnetic flux per unit time leads to decrease in the induced electromotive force to be produced in the conductive layer 1*a*, resulting in decrease in an amount of heat generated by the conductive layer 1*a*.

As understood from the above description, it is important to manage the ratio of the lines of magnetic force passing through the external route to acquire required power conversion efficiency for the fixing apparatus A according to the present exemplary embodiment.

2-3) Index Indicating Ratio of Magnetic Flux Passing Through Outside of Conductive Layer Therefore, the ratio of the lines of magnetic force passing through the external route in the fixing apparatus A is expressed with use of an index called a permeance, which indicates how easily a line of magnetic force can pass through. First, a general idea about a magnetic circuit will be described. A circuit of a magnetic path which a line of magnetic force passes through is referred to as a magnetic circuit, while a circuit of an electric current is referred to as an electric circuit. A magnetic flux in the magnetic circuit can be calculated according to a calculation of the current in the electric circuit. Ohm's law regarding the electric circuit can be employed for the magnetic circuit. An expression 2 can be established, assuming that Φ represents the magnetic flux corresponding to the current in the electric circuit, V represents a magnetomotive force corresponding to an electromotive force, and R represents a magnetic resistance corresponding to an electric resistance.

$$\Phi=V/R \tag{2}$$

However, the relevant principle will be described here with use of a permeance P, which is an inverse of the magnetic resistance R, to facilitate better understanding of the principle. Use of the permeance P allows the above-described expression 2 to be represented by an expression 3.

$$\Phi=V\lambda P \tag{3}$$

Further, this permeance P can be represented by an expression 4, assuming that B represents a length of the magnetic path, S represents a cross-sectional area of the magnetic path, and μ represents a magnetic permeability of the magnetic path.

$$P=\mu\times S/B \tag{4}$$

Figure 21A:
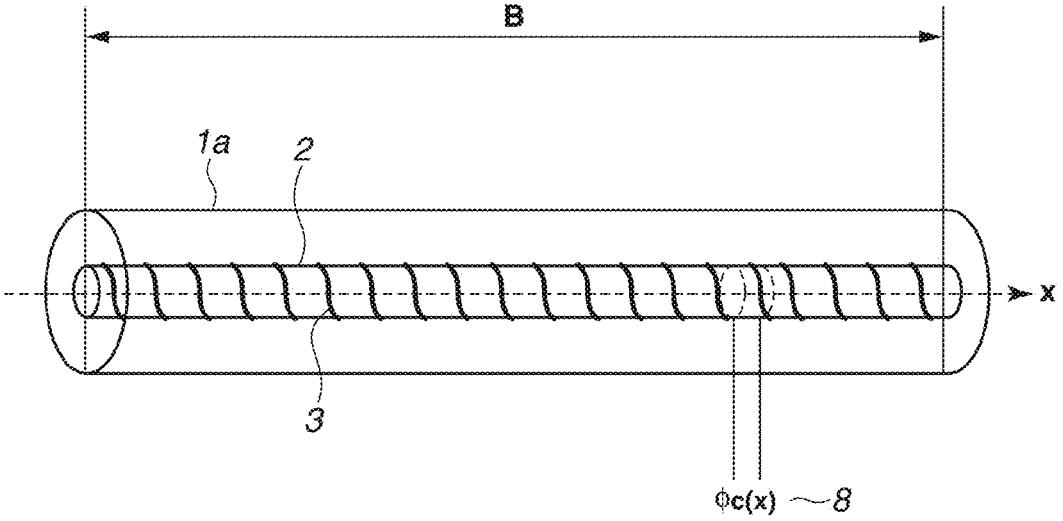
FIGS. 21A and 21B illustrate the magnetic flux.
Figure 21B:
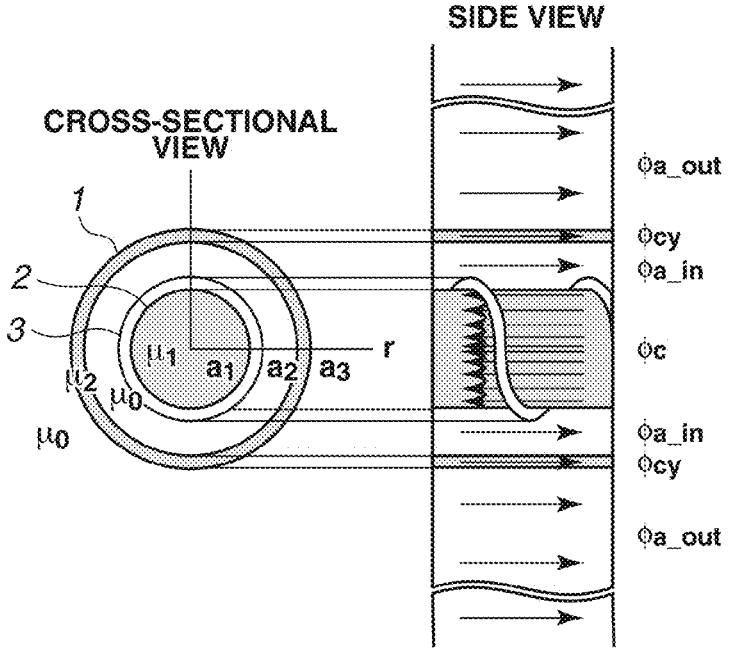

The permeance P is proportional to the cross-sectional area S and the magnetic permeability μ, and is inversely proportional to the magnetic path length B. FIG. 21A illustrates the conductive layer 1*a* containing therein the magnetic core 2 having a radius $a_1$ [m], the length B [m], and a relative magnetic permeability $\mu_1$ with the coil 3 wound around the magnetic core 2 by N turns [turns] in such a manner that the axis of the helix extends substantially in parallel with the generatrix direction of the conductive layer 1*a*. In the example illustrated in FIG. 21A, the conductive layer 1*a* is a conductive body having the length B [m], an inner diameter $a_2$ [m], an outer diameter $a_3$ [m], and a relative magnetic permeability $\mu_2$. A vacuum space inside and outside the conductive layer 1*a* has a magnetic permeability $\mu_0$ [H/m]. A magnetic flux $\phi_{c(x)}$ indicates a magnetic flux 8 that is produced per unit length of the magnetic core 2 when a current I [A] is supplied to the coil 3. FIG. 21B is a cross-sectional view perpendicular to a longitudinal direction of the magnetic core 2. Arrows illustrated in FIG. 21B indicate magnetic fluxes that pass through the inside of the magnetic core 2, the inside of the conductive layer 1, and the outside of the conductive layer 1*a* in parallel with the longitudinal direction of the magnetic core 2 when the current I is supplied to the coil 3. A magnetic flux $\phi_c$ ($=\phi_{c(x)}$) passes through the inside of the magnetic core 2. A magnetic flux $\phi_{a_in}$ passes through the inside of the conductive layer 1*a* (passes through a region between the conductive layer 1*a* and the magnetic core 2). A magnetic flux $\phi_s$ passes through the conductive layer 1*a*. A magnetic flux $\phi_{a_out}$ passes through the outside of the conductive layer 1*a*.

First, a fixing apparatus is described which has a core configured as a single piece member and in which the magnetic core 2 does not include a plurality of divided cores. A fixing apparatus having the magnetic core 2 including a plurality of divided cores will be described below.

Figure 22A:
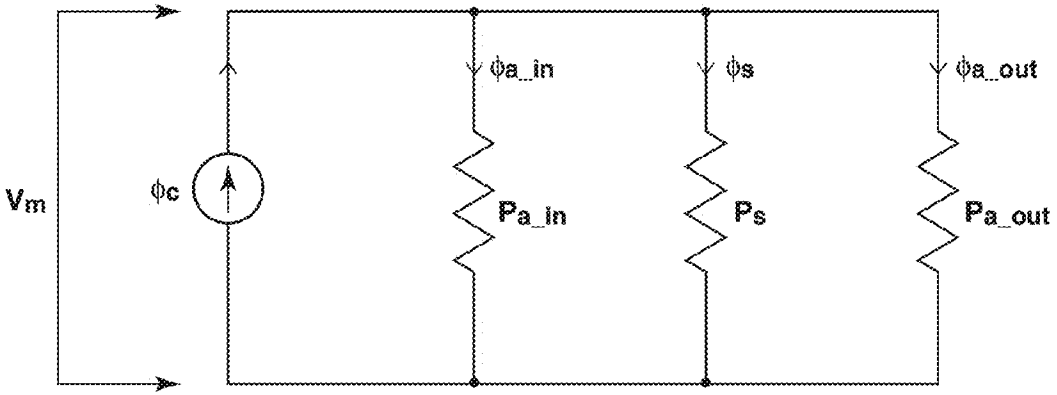
FIGS. 22A and 22B illustrate magnetic equivalent circuits.
Figure 22B:
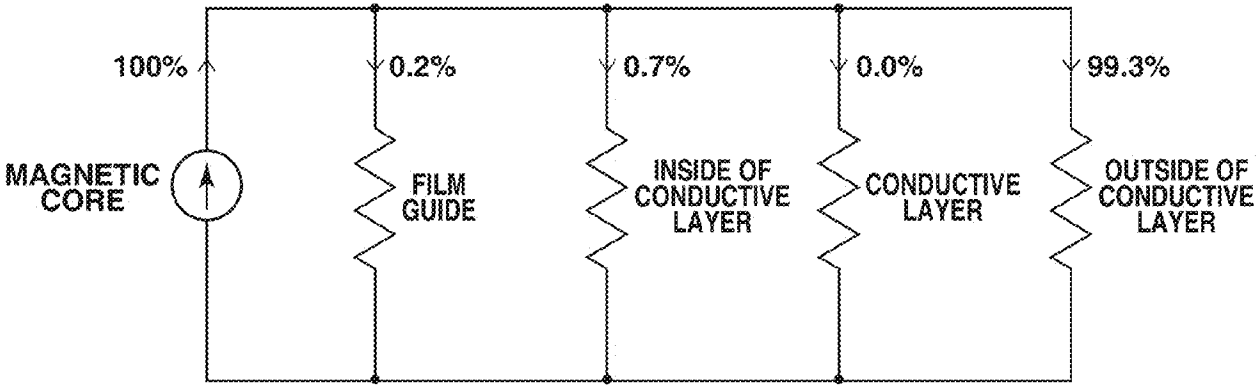

FIG. 22A illustrates a magnetic equivalent circuit of a space containing the magnetic core 2, the coil 3, and the conductive layer 1*a* per unit length illustrated in FIG. 20A. Assume that $V_m$ represents a magnetomotive force produced by the magnetic flux $\phi_c$ passing through the magnetic core 2, $P_c$ represents a permeance of the magnetic core 2, $P_{a_in}$ represents a permeance inside the conductive layer 1*a*, $P_s$ represents a permeance of the interior of the film conductive layer 1*a* itself, and $P_{a_out}$ represents a permeance outside the conductive layer 1*a*.

If the permeance $P_c$ is sufficiently large compared to the permeances $P_{a_in}$ and $P_s$, the magnetic flux passing through the inside of the magnetic core 2 and exiting from the one end of the magnetic core 2 is considered to return to the other end of the magnetic core 2 by passing through any of the magnetic fluxes $\phi_{a_in}$, $\phi_s$, and $\phi_{a_out}$. Therefore, an expression 100 is established.

$$\phi_c=\phi_{a_in}+\phi_s+\phi_{a_out} \tag{100}$$

Further, the magnetic fluxes $\phi_c$, $\phi_{a_in}$, $\phi_s$, and $\phi_{a_out}$ are represented by the following expressions 5 to 8, respectively.

$$\phi_c=P_c\times V_m \tag{5}$$

$$\phi_s=P_s\times V_m \tag{6}$$

$$\phi_{a_in}=P_{a_in}\times V_m \tag{7}$$

$$\phi_{a_out}\phi_{a_out}V_m \tag{8}$$

Therefore, if the expressions 5 to 8 are substituted into the expression 100, the permeance $P_{a_out}$ is represented by an expression 9.

$$P_c \times V_m = P_{a_in} \times V_m + P_s \times V_m + P_{a_out} \times V_m = (P_{a_in} + P_s P_{a_out}) \times V_m \therefore P_{a_out} = P_c - P_{a_in} - P_s \quad (9)$$

The permeances can be expressed as "magnetic permeability×cross-sectional area" as indicated by expressions 10 to 12 according to the illustration of FIG. 21B, assuming that $S_c$ represents a cross-sectional area of the magnetic core 2, $S_{a_in}$ represents a cross-sectional area inside the conductive layer 1*a*, and $S_s$ represents a cross-sectional area of the conductive layer 1*a*. The unit is [H·m].

$$P_c = \mu_1 \cdot S_c = \mu_1 \cdot \pi (a_1)^2 \quad (10)$$

$$P_{a_in} = \mu_0 \cdot S_{a_in} = \mu_0 \cdot \pi \cdot ((a_2)^2 - (a_1)^2) \quad (11)$$

$$P_s = \mu_2 \cdot S_s = \mu_2 \cdot \pi \cdot ((a_3)^2 - (a_2)^2) \quad (12)$$

By substituting these expressions 10 to 12 into the expression 9, the permeance $P_{a_out}$ can be represented by an expression 13.

$$P_{a_out} = P_c - P_{a_in} - P_s = \mu_1 \cdot S_c - \mu_0 \cdot S_{a_in} - \mu_2 \cdot S_s = \pi \cdot \mu_1 \cdot (a_1)^2 - \pi \cdot \mu_0 \cdot ((a_2)^2 - (a_1)^2) - \pi \cdot \mu_2 \cdot ((a_3)^2 - (a_2)^2) \quad (13)$$

With use of the above-described expression 13 $P_{a_out}/P_c$, which is the ratio of the lines of magnetic force passing through outside the conductive layer 1*a*, can be calculated.

The magnetic resistance R may be used instead of the permeance P. If the ratio of the lines of magnetic force passing through the outside of the conductive layer 1*a* is described with use of the magnetic resistance R, the magnetic resistance R is simply an inverse of the permeance P so that the magnetic resistance R per unit length can be represented as "1/(magnetic permeability×cross-sectional area)". The unit is "1/(H·m)".

A result of a specific calculation with use of parameters of the apparatus according to the present exemplary embodiment is indicated in a following table 1.

TABLE 1

| | UNIT | MAGNETIC CORE | FILM GUIDE | INSIDE CONDUCTVE LAYER | CONDUCTIVE LAYER | OUTSIDE CONDUCTIVE LAYER |
|---|---|---|---|---|---|---|
| CROSS-SECTIONAL AREA | m^2 | 1.5E−04 | 1.0E−04 | 2.0E−04 | 1.5E−06 | |
| RELATIVE MAGNETIC PERMEABILITY | | 1800 | 1 | 1 | 1 | |
| MAGNETIC PERMEABILITY | H/m | 2.3E−3 | 1.3E−6 | 1.3E−6 | 1.3E−6 | |
| PERMEANCE PER UNIT LENGTH | H · m | 3.5E− 07 | 1.3E−10 | 2.5E−10 | 1.9E−12 | 3.5E−07 |
| MAGNETIC RESISTANCE PER UNIT LENGTH | 1/(H · m) | 2.9E+06 | 8.0E+09 | 4.0E+09 | 5.3E+11 | 2.9E+06 |
| RATIO OF MAGNETIC FLUX | % | 100.0% | 0.0% | 0.1% | 0.0% | 99.9% |

The magnetic core 2 is made from ferrite (having a relative magnetic permeability of 1800), and has a diameter of 14 [mm] and a cross-sectional area of $1.5\times10^{-4}$ [$m^2$]. A film guide is made from Polyphenylenesulfide (PPS) (having a relative magnetic permeability of 1.0), and has a cross-sectional area of $1.0\times10^{-4}$ [$m^2$]. The conductive layer 1*a* is made from aluminum (having a relative magnetic permeability of 1.0), and has a diameter of 24 [mm], a thickness of 20 [μm], and a cross-sectional area of $1.5\times10^{-6}$ [$m^2$].

The cross-sectional area of the region between the conductive layer 1*a* and the magnetic core 2 is calculated by subtracting the cross-sectional area of the magnetic core 2 and the cross-sectional area of the film guide from a cross-sectional area of a hollow portion inside the conductive layer 1*a* having the diameter of 24 [mm]. The elastic layer 1*b* and the surface layer 1*c* are disposed on an outer side of the conductive layer 1*a*, and do not contribute to the heat generation. Therefore, they can be considered as an air layer outside the conductive layer 1*a* in the magnetic circuit model in calculating the permeance, and therefore do not have to be included in the calculation.

According to the table 1, the permeances $P_c$, $P_{a_in}$, and $P_s$ have the following values.

$$P_c = 3.5\times10^{-7} [H\cdot m]$$

$$P_{a_in} = 1.3\times10^{-10} + 2.5\times10^{-10} [H\cdot m]$$

$$P_s = 1.9\times10^{-12} [H\cdot m]$$

The ratio $P_{a_out}/P_c$ can be calculated with use of these values according to an expression 14.

$$P_{a_out}/P_c = (P_c - P_{a_in} - P_s)/P_c = 0.999 (99.9\%) \quad (14)$$

Next, the magnetic core 2 may be divided into a plurality of pieces in the longitudinal direction, and a gap (an interval) may be provided between the respective divided magnetic cores (divided cores), like the present exemplary embodiment. In this case, if this gap is filled with air, a material having a relative magnetic permeability that can be regarded as 1.0, or a material having a far smaller relative magnetic permeability than the magnetic core 2, the magnetic resistance R of the entire magnetic core 2 increases, resulting in deterioration of the function of guiding the lines of magnetic force.

Now, in the case where the magnetic core 2 includes a plurality of divided cores arranged in the generatrix direction of the fixing sleeve 1, and a gap is formed at a boundary between the divided cores or a non-magnetic body such as a polyethylene terephthalate (PET) sheet is inserted between the divided cores, a method for calculating the permeance of the entire magnetic core 2 will be described. In this case, a magnetic resistance per unit length should be acquired by calculating a magnetic resistance of the entire magnetic core 2 in the longitudinal direction, and then dividing the calculated magnetic resistance by the entire length. Then, a permeance per unit length should be acquired by calculating an inverse of the magnetic resistance per unit length.

Figure 23:
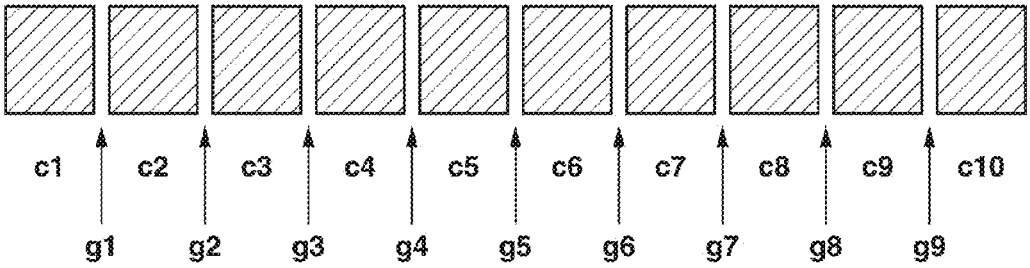
FIG. 23 illustrates a configuration of the magnetic core in a longitudinal direction.

First, FIG. 23 illustrates a configuration of the magnetic core 2 in the longitudinal direction. Magnetic cores c1 to c10 each have the cross-sectional area $S_c$, the magnetic permeability $\mu_c$, and a width $L_c$ per divided magnetic core. Intervals (gaps) g1 to g9 each have a cross-sectional area $S_g$, a magnetic permeability $\mu_g$, and a width $L_g$ per gap. In this case, a magnetic resistance $R_{m_all}$ of the entire magnetic core 2 in the longitudinal direction is represented by a following expression 15.

$$R_{m_all}=(R_{m_c1}+R_{m_c2}+\ldots+R_{m_c10})+(R_{m_g1}+R_{m_g2}+\ldots+R_{m_g9}) \tag{15}$$

According to the present configuration, the magnetic cores c1 to c10 have the same shapes and are made from the same materials, and the gaps g1 to g9 have equal widths. Therefore, the magnetic resistances can be represented by the following expressions 16 to 18, in which a sum of the magnetic resistances $R_{m_c}$ is indicated as $\Sigma R_{m_c}$ and a sum of the magnetic resistances $R_{m_g}$ is indicated as $\Sigma_{Rm_g}$.

$$R_{m_all}=(\Sigma R_{m_c})+(\Sigma R_{m_g}) \tag{16}$$

$$R_{m_c}=L_c/(\mu_c \cdot S_c) \tag{17}$$

$$R_{m_g}=L_g/(\mu_g \cdot S_g) \tag{18}$$

By substituting the expressions 17 and 18 into the expression 16, the magnetic resistance $R_{m_all}$ of the entire magnetic core 2 in the longitudinal direction can be represented by the following expression 19.

$$R_{m_all}=(\Sigma R_{m_c})+(\Sigma R_{m_g})=(L_c/(\mu_c \cdot S_c))\times 10+(L_g/(\mu_g \cdot S_g))\times 9 \tag{19}$$

Then, the magnetic resistance $R_m$ per unit length is represented by a following expression 20, in which a sum of the widths $L_c$ is indicated as $\Sigma L_c$ and a sum of the widths $L_g$ is indicated as $\Sigma L_g$.

$$R_m=R_{m_all}/(\Sigma L_c+\Sigma L_g)=R_{m_all}/(L_c\times 10+L_g\times 9) \tag{20}$$

From these expressions, the permeance $P_m$ per unit length can be represented by a following expression 21.

$$P_m=1/R_m=(\Sigma L_c+\Sigma L_g)/R_{m_{all}}=(\Sigma L_c+\Sigma L_g)/[\{\Sigma L_c/(\mu_c \cdot S_c)\}+\{\Sigma L_g/(\mu_g \cdot S_g)\}] \tag{21}$$

Thus, it can be seen that the ratio of the lines of magnetic force passing through the external route in the fixing apparatus having the magnetic core 2 including the plurality of divided cores, like the present exemplary embodiment, can be represented with use of the permeance or the magnetic resistance.

2-4) Power Conversion Efficiency Required for Apparatus

Next, the power conversion efficiency required for the fixing apparatus A according to the present exemplary embodiment will be described. For example, if the power conversion efficiency is 80%, power of remaining 20% is converted into heat energy and is consumed by the coil 3, the core 2, and the like other than the conductive layer 1*a*. If the power conversion efficiency is low, the members that should not generate heat, such as the magnetic core 2 and the coil 3, may generate heat, which necessitates a measure for cooling down these members.

In the present exemplary embodiment, to cause the conductive layer 1*a* to generate heat, a high-frequency alternating current is supplied to the exciting coil 3 to produce a alternating magnetic field. This alternating magnetic field induces a current on the conductive layer 1*a*. As a physical model, this mechanism highly resembles magnetic coupling of a transformer. Therefore, an equivalent circuit of magnetic coupling of a transformer can be used to consider the power conversion efficiency. The exciting coil 3 and the conductive layer 1*a* are magnetically coupled to each other due to this alternating magnetic field, and power supplied to the exciting coil 3 is transmitted to the conductive layer 1*a*. The "power conversion efficiency" described here means a ratio of the power supplied to the exciting coil 3, which is a magnetic field generation unit, to the power consumed by the conductive layer 1*a*. In the present exemplary embodiment, the power conversion efficiency means a ratio of the power supplied to a high-frequency converter 16 illustrated in FIG. 4 to the power consumed by the conductive layer 1*a*. Power supplied to the exciting coil 3 and consumed by other members than the conductive layer 1*a* includes a loss due to a resistance of the exciting coil 3, a loss due to a magnetic characteristic of the material of the magnetic core 2, and the like.

Figure 5A:
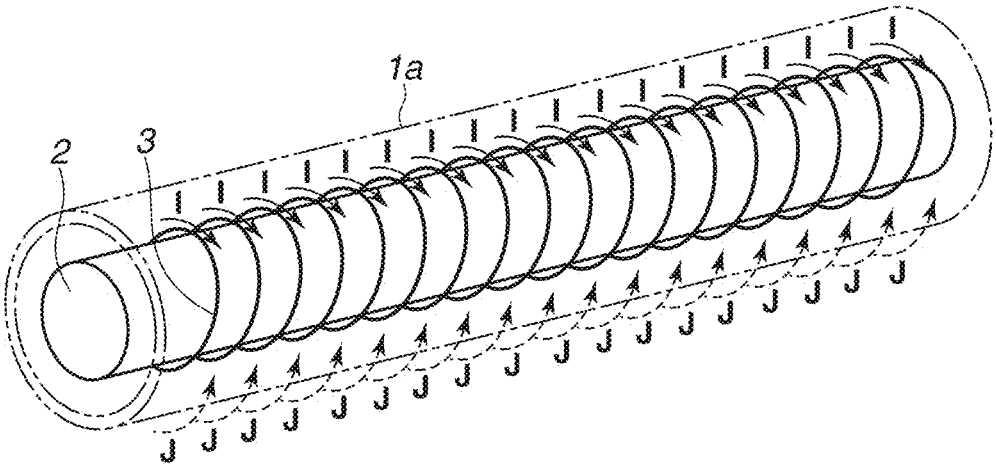
FIGS. 5A and 5B illustrate efficiency of a circuit of the fixing apparatus.
Figure 5B:
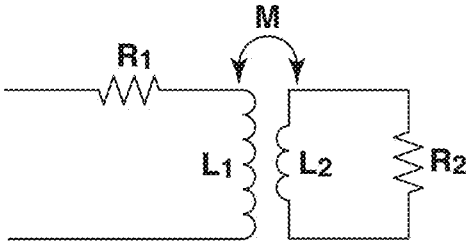

FIGS. 5A and 5B illustrate the efficiency of the circuit. FIG. 5A illustrates the conductive layer 1*a*, the magnetic core 2, and the exciting coil 3. FIG. 5B illustrates an equivalent circuit.

Figure 6A:
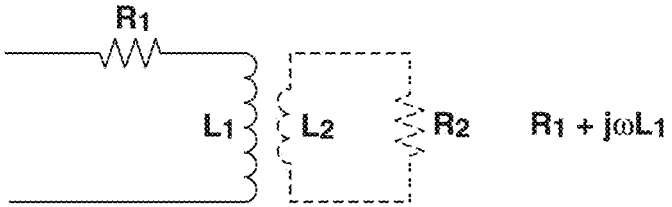
FIGS. 6A, 6B, and 6C illustrate power conversion efficiency.

The equivalent circuit illustrated in FIG. 5B includes a loss $R_1$ due to the exciting coil 3 and the magnetic core 2, an inductance $L_1$ of the exciting oil 3 wound around the magnetic core 2, a mutual inductance M of the winding and the conductive layer 1*a*, an inductance $L_2$ of the conductive layer 1*a*, and a resistance $R_2$ of the conductive layer 1*a*. FIG. 6A illustrates an equivalent circuit when the conductive layer 1*a* is not mounted. When the series equivalent resistance $R_1$ from both ends of the exciting coil 3 and the equivalent inductance $L_1$ are measured with use of an apparatus such as an impedance analyzer and an inductance-capacitance-resistance (LCR) meter, an impedance $Z_A$ as viewed from the both ends of the exciting coil 3 can be represented by an expression 22.

$$Z_A=R_1+j\omega L_1 \tag{22}$$

A current flowing through this circuit incurs a loss due to the resistance $R_1$. In other words, the resistance $R_1$ indicates the loss derived from the coil 3 and the magnetic coil 2.

Figure 6B:
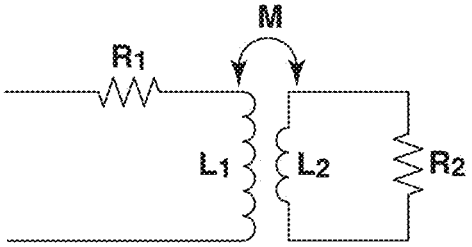

FIG. 6B illustrates an equivalent circuit when the conductive layer 1*a* is mounted. An expression 25 is acquired by calculating the following expressions 23 and 24 in this series equivalent circuit when the conductive layer 1*a* is mounted and performing equivalent conversion illustrated in FIG. 6C.

$$R_x = R_1 + \frac{\omega^2 M^2 R_2}{R_2^2 + \omega^2 L_2^2} \tag{23}$$

$$L_x = \omega(L_1 - M) + \frac{M \cdot R_2^2 + \omega^2 M L_2 (L_2 - M)}{R_2^2 + \omega^2 L_2^2} \tag{24}$$

$$z = R_1 + j\omega(L_1 - M) + \frac{j\omega M(j\omega(L_2 - M) + R_2)}{j\omega M + j\omega(L_2 - M) + R_2} = \tag{25}$$

-continued $$R_1 + \frac{\omega^2 M^2 R_2}{R_2^2 + \omega^2 L_2^2} + j\omega(L_1 - M) + \frac{M \cdot R_2^2 + \omega^2 M L_2 (L_2 - M)}{R_2^2 + \omega^2 L_2^2}$$

In these expressions, M represents the mutual inductance of the exciting coil 3 and the conductive layer 1*a*.

Figure 6C:
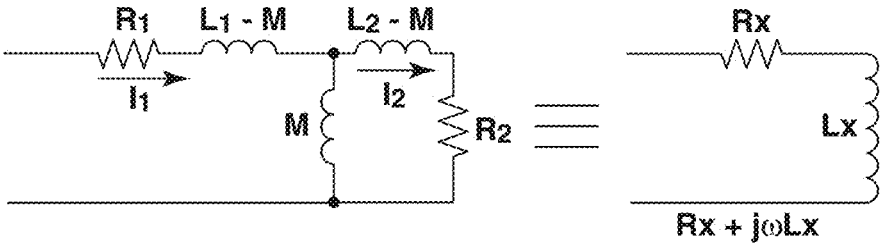

As illustrated in FIG. 6C, an expression 26 is established, where $I_1$ represents a current flowing through the resistance $R_1$, and $I_2$ represents a current flowing through the resistance $R_2$.

$$j\omega M(I_1 - I_2) = (R_2 + j\omega(L_2 - M))I_2 \quad (26)$$

Further, an expression 27 can be acquired from the expression 26.

$$I_1 = \frac{R_2 + j\omega L_2}{j\omega M} I_2 \quad (27)$$

The efficiency (the power conversion efficiency) is represented as (power consumed by the resistance $R_2$)/(power consumed by the resistance $R_1$+power consumed by the resistance $R_2$), and therefore can be represented by an expression 28.

$$\text{POWER CONVERSION EFFICIENCY} = \frac{R_2 \times |I_2^2|}{R_1 \times |I_1^2| + R_2 \times |I_2^2|} = \frac{\omega^2 M^2 R_2}{\omega^2 L_2^2 R_1 + R_1 R_2^2 + \omega^2 M^2 R_2} = \frac{R_X - R_1}{R_X} \quad (28)$$

Figure 24:
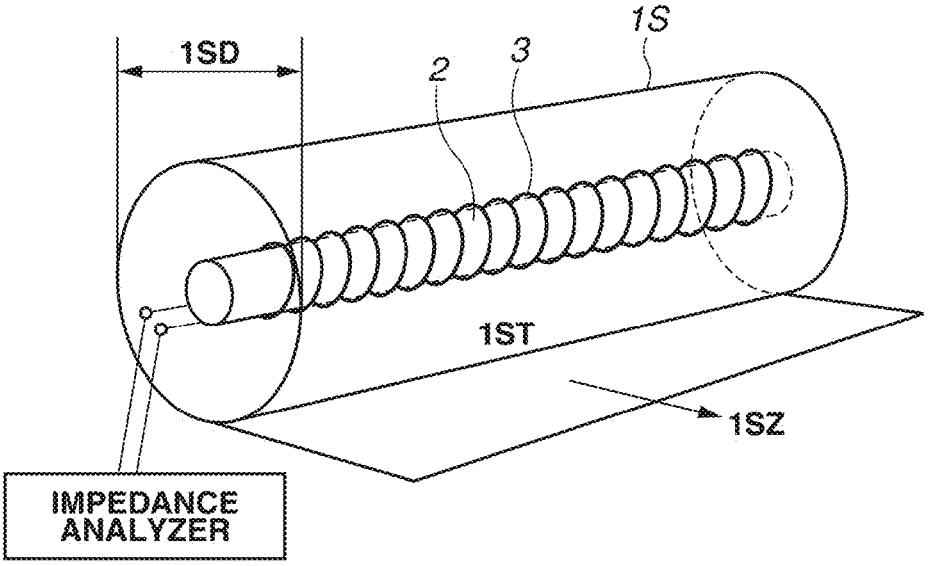
FIG. 24 illustrates an experiment apparatus for use in an experiment of measuring the power conversion efficiency.

The power conversion efficiency, which indicates how much power is consumed by the conducive layer 1*a* with respect to the power supplied to the exciting coil 3, can be acquired by measuring the series equivalent resistance $R_1$ before the conductive layer 1*a* is mounted and the series equivalent resistance $R_x$ after the conductive layer 1*a* is mounted. In the present exemplary embodiment, Impedance Analyzer 429A manufactured by Agilent Technologies, Inc. was used to measure the power conversion efficiency. First, the series equivalent resistance $R_1$ from the both ends of the winding was measured without mounting the fixing film. Next, the series equivalent resistance $R_x$ from the both ends of the winding was measured with the magnetic core 2 inserted in the fixing film. The measurement result was $R_1$=103 mΩ and $R_x$=2.2Ω so that 95.3% could be acquired as the power conversion efficiency at this time according to the expression 28. Hereinafter, the performance of a fixing apparatus will be evaluated with use of this power conversion efficiency. Next, the power conversion efficiency will be evaluated by varying the ratio of the magnetic flux passing through the external route of the conductive layer 1*a*. FIG. 24 illustrates an experiment apparatus for use in an experiment of measuring the power conversion efficiency. A metallic sheet 1S is an aluminum sheet having a width of 230 mm, a length of 600 mm, and a thickness of 20 μm. This metallic sheet 1S is cylindrically rolled so as to surround the magnetic core 2 and the coil 3, and a portion indicated by a thick line 1ST is brought into conductivity to become the conductive layer. The magnetic core 2 is ferrite having a relative magnetic permeability of 1800 and a saturation magnetic flux density of 500 mT, and takes a columnar shape having a cross-sectional area of 26 $mm^2$ and a length of 230 mm. The magnetic core 2 is disposed at a substantially central position of the cylinder formed from the aluminum sheet 1S with use of a not-illustrated fixing unit. The coil 3 is helically wound around the magnetic core 2 by twenty-five turns. A diameter 1SD of the conductive layer can be adjusted within a range of 18 to 191 mm by pulling an edge of the metallic sheet 1S in a direction indicated by an arrow 1SZ.

Figure 25:
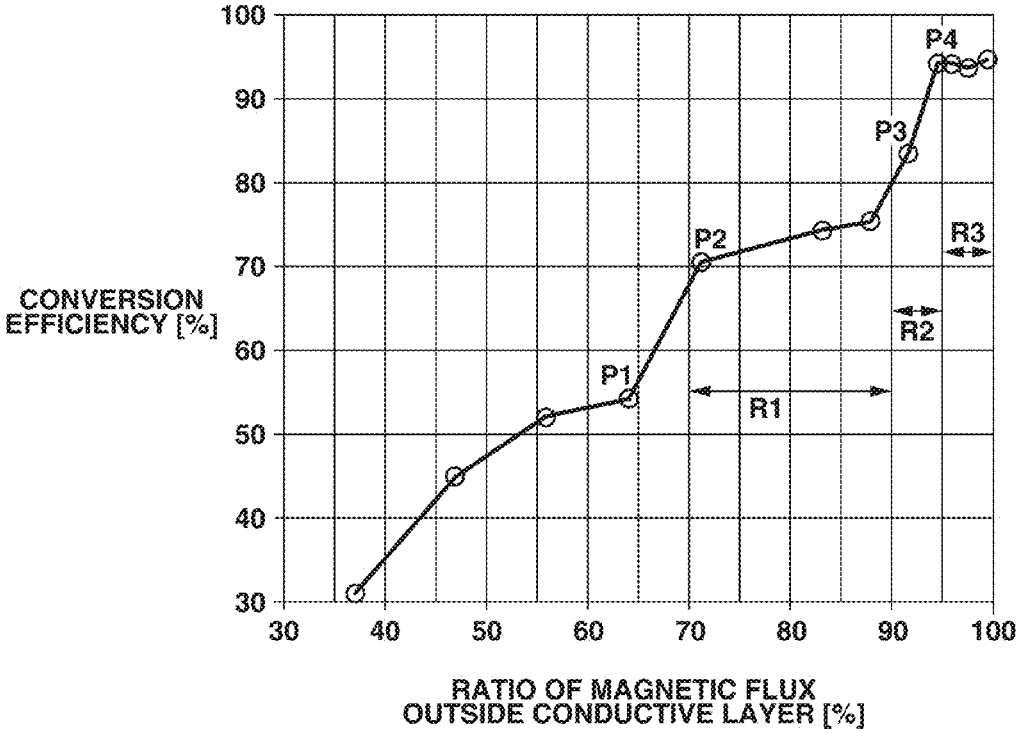
FIG. 25 illustrates the power conversion efficiency.

FIG. 25 illustrates a graph in which the ratio [%] of the magnetic flux passing through the external route of the conductive layer 1*a* is set to a horizontal axis, and the power conversion efficiency with a frequency of 21 kHz is set to a vertical axis.

The power conversion efficiency drastically increases after a plotted point P1 in the graph of FIG. 25 to exceed 70%, and is maintained at 70% or higher in a range R1 indicated by an arrow. The power conversion efficiency drastically increases again at around a plotted point P3, and is maintained at 80% or higher in a range R2. The power conversion efficiency is stabilized at a high value of 94% or higher in a range R3 after a plotted point P4. A start of this drastic increase in the power conversion efficiency is due to a start of an efficient flow of a loop current around the conductive layer.

A following table 2 indicates a result of an experiment in which configurations corresponding to the plotted points P1 to P4 illustrated in FIG. 25 were actually designed as image heating apparatuses, and were evaluated.

TABLE 2

| NUMBER | REGION | DIAMETER OF CONDUCTIVE LAYER [mm] | RATE OF MAGNETIC FLUX PASSING THROUGH OUTSIDE OF CONDUCTIVE LAYER | CONVERSION EFFICIENCY [%] | EVALUATION RESULT (PROVIDED THAT FIXING APPARATUS IS HIGH-SPEC) |
|---|---|---|---|---|---|
| P1 | — | 143.2 | 64.0 | 54.4 | POWER MAY BE INSUFFICIENT |
| P2 | R1 | 127.3 | 71.2 | 70.8 | COOLING UNIT IS DESIRABLY PROVIDED |
| P3 | R2 | 63.7 | 91.7 | 83.9 | OPTIMIZATION OF HEAT-RESISTANT DESIGN IS DESIRABLE |

TABLE 2-continued

| NUMBER | REGION | DIAMETER OF CONDUCTIVE LAYER [mm] | RATE OF MAGNETIC FLUX PASSING THROUGH OUTSIDE OF CONDUCTIVE LAYER | CONVERSION EFFICIENCY [%] | EVALUATION RESULT (PROVIDED THAT FIXING APPARATUS IS HIGH-SPEC) |
|---|---|---|---|---|---|
| P4 | R3 | 47.7 | 94.7 | 94.7 | CONFIGURATION OPTIMUM FOR FLEXIBLE FILM |

(FIXING APPARATUS P1)

According to the present configuration, the magnetic core 2 has a cross-sectional area of 26.5 $mm^2$ (5.75 mm×4.5 mm). The conductive layer has a diameter of 143.2 mm. The ratio of the magnetic flux passing through the external route is 64%. The power conversion efficiency of this apparatus was measured by the impedance analyzer, and the result was 54.4%. The power conversion efficiency is a parameter that indicates power having contributed to heat generation of the conductive layer with respect to the power supplied to the fixing apparatus. Therefore, even if the fixing apparatus P1 is designed as a fixing apparatus capable of outputting 1000 W at a maximum, approximately 450 W thereof becomes a loss, and this loss is turned into heat generation of the coil 3 and the magnetic core 2.

According to the present configuration, when the apparatus is powered on, the temperature of the coil 3 may exceed 200° C. only by supplying 1000 W for several seconds. The loss of 45% makes it difficult to maintain the temperatures of the members such as the exciting coil 3 under upper temperature limits, in consideration of the facts that an upper limit temperature of an insulating body of the coil 3 is from 250° C. to 300° C., and a Curie point of the magnetic core 2 made from ferrite is normally approximately 200° C. to 250° C. Further, if the temperature of the magnetic core 2 exceeds the Curie point, the inductance of the coil 3 drastically decreases, causing a load fluctuation.

Since approximately 45% of the power supplied to the fixing apparatus P1 is not used for heat generation of the conductive layer, power of approximately 1636 W should be supplied to supply power of 900 W (assuming that 90% of 1000 W is supplied) to the conductive layer. This means that a power source consumes 16.36 A when 100 V is input. This may exceed an allowable current that can be supplied from an attachment plug for a commercial alternating-current. Therefore, the fixing apparatus P1 corresponding to the power conversion efficiency of 54.4% may insufficiently supply the power to the fixing apparatus P1.

(Fixing Apparatus P2)

According to the present configuration, the magnetic core 2 has a cross-sectional area equal to the fixing apparatus P1. The conductive layer has a diameter of 127.3 mm. The ratio of the magnetic flux passing through the external route is 71.2%. The power conversion efficiency of this apparatus was measured by the impedance analyzer, and the result was 70.8%. Temperature increases of the coil 3 and the core 2 may become a problem depending on the specification of the fixing apparatus P2. If the fixing apparatus P2 according to the present embodiment is a high-spec fixing apparatus capable of performing a printing operation by 60 pages per minute, the conductive layer rotates at a speed of 330 mm/sec, and the temperature of the conductive layer should be maintained at 180° C. In order to maintain the temperature of the conductive layer at 180° C., the temperature of the magnetic core 2 sometimes exceeds 240° C. in twenty seconds. Since the Curie point of the ferrite used as the magnetic core 2 is normally approximately 200° C. to 250° C., the ferrite may exceed the Curie point so that the magnetic permeability of the magnetic core 2 may drastically decrease, which may make it impossible for the magnetic core 2 to appropriately guide the lines of magnetic force. As a result, it may become difficult to induce the loop current to cause the conductive layer to generate heat.

Therefore, if the fixing apparatus having the ratio of the magnetic flux passing through the external route within the range R1 is the above-described high-spec fixing apparatus, it is desirable to provide a cooling unit for reducing the temperature of the ferrite core. An air-cooling fan, a water-cooling unit, a heat sink, a radiating fin, a heat pipe, a Peltier device, and the like can be used as the cooling unit. Needless to say, the cooling unit is unnecessary if the configuration does not have to be so much high-spec.

(Fixing Apparatus P3)

According to the present configuration, the magnetic core 2 has a cross-sectional area equal to the fixing apparatus P1. The conductive layer is 63.7 mm in diameter. The power conversion efficiency of this apparatus was measured by the impedance analyzer, and the result was 83.9%. Although a heat amount is invariably generated at the magnetic core 2, the coil 3, and the like, this heat generation does not reach a level that necessitates the cooling unit. If the fixing apparatus P3 according to the present embodiment is configured to be the high-spec fixing apparatus capable of performing the printing operation by 60 pages per minute, the conductive layer rotates at a speed of 330 mm/sec, and the surface temperature of the conductive layer is maintained at 180° C. However, the temperature of the magnetic core 2 (ferrite) 2 does not exceed 220°. Therefore, if the fixing apparatus P3 according to the present embodiment is configured to be the above-described high-spec fixing apparatus, it is desirable to use ferrite having a Curie point of 220° C. or higher.

As understood from the above description, if the fixing apparatus having the ratio of the magnetic flux passing through the external route within the range R2 is used as the high-spec fixing apparatus, it is desirable to optimally design a heat-resistance of ferrite and the like. On the other hand, such a heat-resistant design is unnecessary if the fixing apparatus does not have to be high-spec.

(Fixing Apparatus P4)

According to the present configuration, the magnetic core 2 has a cross-sectional area equal to the fixing apparatus P1.

The cylindrical body has a diameter of 47.7 mm. The power conversion efficiency of this apparatus was measured by the impedance analyzer, and the result was 94.7%. Even if the fixing apparatus P4 according to the present embodiment is configured to be the high-spec fixing apparatus capable of performing the printing operation by 60 pages per minute (the conductive layer rotates at a speed of 330 mm/sec) and the surface temperature of the conductive layer is maintained at 180° C., the temperatures of the exciting coil 3, the core 2, and the like do not exceed 180° C. Therefore, the present configuration does not require the cooling unit for cooling down the magnetic core 2, the coil 3, and the like, and a special heat-resistant design.

As understood from the above description, if the fixing apparatus has the ratio of the magnetic flux passing through the external route within the range R3 which exceeds 94.7%, the power conversion efficiency reaches or exceeds 94.7% and therefore is sufficiently high. Accordingly, even if the present configuration is used further as a high-spec fixing apparatus, the cooling unit is unnecessary.

Further, in the range R3 where the power conversion efficiency is stabilized at a high value, even when a slight change occurs in an amount of the magnetic flux passing through the inside of the conductive layer per unit time due to a change in the positional relationship between the conductive layer and the magnetic core 2, a power conversion amount is small, so that efficiency change is small and the conductive layer can generate heat in a stabilized quantity. There is substantial merit when the region R3 is used where the power conversion efficiency remains stabilized at a high value in a fixing apparatus in which the distance between the conductive layer and the magnetic core 2, like a flexible film tends to vary.

From the above description, it can be understood that in the fixing apparatus A according to the present exemplary embodiment, the ratio of the magnetic flux passing through the external route should be 72% or higher in order to satisfy at least the required power conversion efficiency.

In the table 2, in the fixing apparatus P2 in the range R1 according to the present exemplary embodiment, the ratio of the magnetic flux passing through the external route of the conductive layer is 71.2% or higher, but this is rounded to 72% in consideration of a measurement error.

2-5) Relational Expression of Permeances or Magnetic Resistances that Apparatus should Satisfy The ratio of 72% or higher of the magnetic flux passing through the external route of the conductive layer is equivalent to 28% or lower of the permeance of the magnetic core 2 which is a sum of the permeance of the conductive layer and the permeance inside the conductive layer (the region between the conductive layer and the magnetic core 2). Therefore, one of characteristic features of the present exemplary embodiment is satisfaction of a following expression 29, where $P_c$ represents the permeance of the magnetic core 2, $P_a$ represents the permeance inside the conductive layer 1*a*, and $P_s$ represents the permeance of the conductive layer 1*a*.

$$0.28\times P_c \geq P_s + P_a \tag{29}$$

Further, if the relational expression of the permeances is represented, the permeances being replaced with the magnetic resistances, the expression is converted into a following expression 30.

$$0.28\times P_c \geq P_s + P_a \tag{30}$$

$$0.28\times \frac{1}{R_c} \geq \frac{1}{R_s} + \frac{1}{R_a}$$

-continued $$0.28\times \frac{1}{R_c} \geq \frac{1}{R_{sa}}$$

$$0.28\times R_{sa} \geq R_c$$

The combined magnetic resistance $R_{sa}$, which is a combination of the resistances $R_s$ and $R_a$, is calculated according to a following expression 31.

$$\frac{1}{R_{sa}} = \frac{1}{R_s} + \frac{1}{R_a} \tag{31}$$

$$R_{sa} = \frac{R_a \times R_s}{R_a + R_s}$$

$R_a$: the magnetic resistance of the magnetic core 2

$R_s$: the magnetic resistance of the conductive layer 1*a*

$R_a$: the magnetic resistance of the region between the conductive layer 1*a* and the magnetic core 2

$R_{sa}$: the combined magnetic resistance of the magnetic resistances $R_s$ and $R_a$ It is desirable that the above-described relational expression of the permeances or the magnetic resistances is satisfied over a whole extent of a maximum region of the image heating apparatus which the recording material P is conveyed through (a maximum region which an image passes through), in cross-section perpendicular to the generatrix direction of the cylindrical rotatable member.

Similarly, in the fixing apparatus P3 in the range R2 according to the present exemplary embodiment, the ratio of the magnetic flux passing through the external route of the conductive layer is 92% or higher. In the table 2, with respect to the fixing apparatus P3 in the range R2 according to the present exemplary embodiment, the ratio of the magnetic flux passing through the external route of the conductive layer is 91.7% or higher, but this is rounded to 92% in consideration of a measurement error. The ratio of 92% or higher of the magnetic flux passing through the external route of the conductive layer is equivalent to 8% or lower of the permeance of the magnetic core 2 which is the sum of the permeance of the conductive layer and the permeance inside the conductive layer (the region between the conductive layer and the magnetic core 2). Therefore, a following expression 32 is acquired as a relational expression of the permeances.

$$0.08\times P_c \geq P_s + P_a \tag{32}$$

The following expression 33 is acquired by converting the above-described relational expression of the permeances into a relational expression of the magnetic resistances.

$$0.08\times P_c \geq P_s + P_a$$

$$0.08\times R_{sa} \geq R_c \tag{33}$$

Further, in the fixing apparatus P4 in the range R3 according to the present exemplary embodiment, the ratio of the magnetic flux passing through the external route of the conductive layer is 95% or higher. In the table 2, in the fixing apparatus P4 in the range R3 according to the present exemplary embodiment, the ratio of the magnetic flux passing through the external route of the conductive layer is 94.7% or higher, but this is rounded to 95% in consideration of a measurement error and the like. The ratio of 95% or higher of the magnetic flux passing through the external route of the conductive layer is equivalent to 5% or lower of the permeance of the magnetic core 2 which is the sum of the permeance of the conductive layer and the permeance inside the conductive layer (the region between the conductive layer and the magnetic core 2). Therefore, a following expression 34 is acquired as a relational expression of the permeances.

$$0.05\times P_c \geq P_s + P_a \quad (34)$$

The following expression 35 is acquired by converting the expression 34 into a relational expression of the magnetic resistances.

$$0.05\times P_c \geq P_s + P_a$$

$$0.05\times R_{sa} \geq R_c \quad (35)$$

Figure 26:
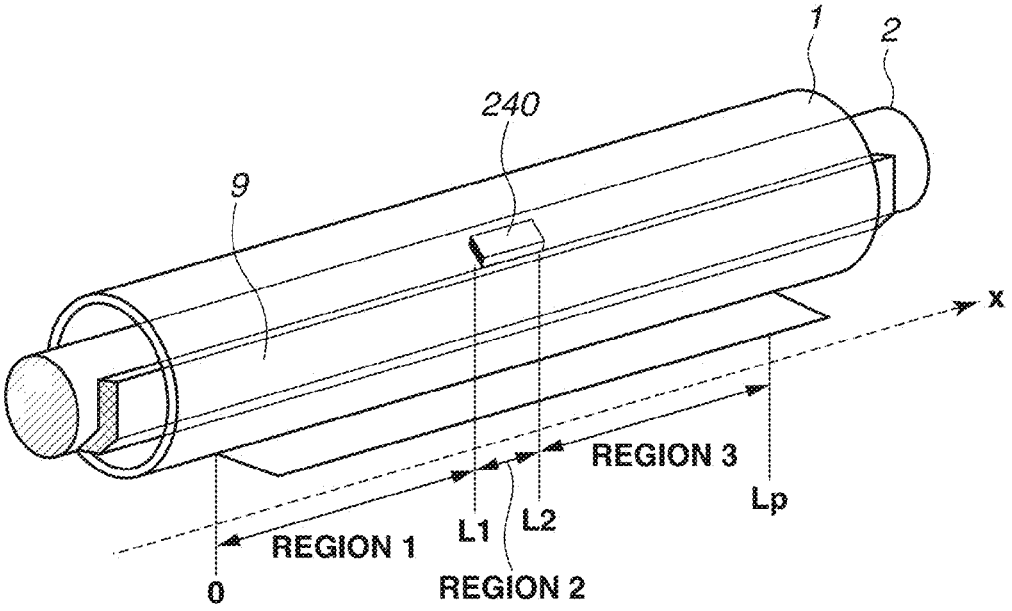
FIG. 26 illustrates a configuration of the fixing apparatus in cross-section.
Figure 27A:
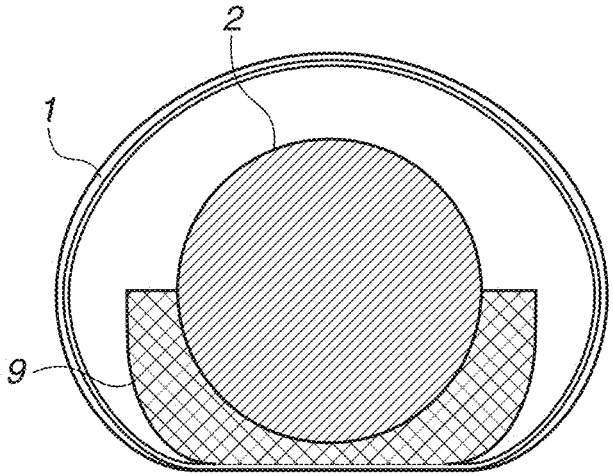
FIGS. 27A and 27B illustrate a configuration of the fixing apparatus in cross-section.
Figure 27B:
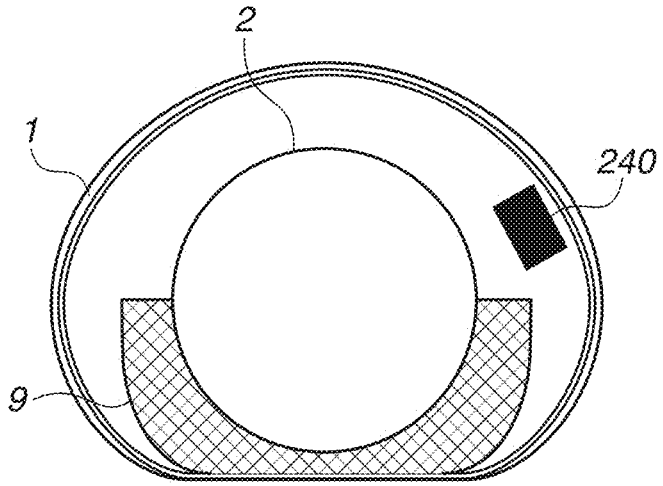

The relational expressions of the permeances and the magnetic resistances have been described with respect to the fixing apparatus in which the members and the like in a maximum image region of the fixing apparatus have an even cross-sectional configuration in the longitudinal direction. Next, a fixing apparatus in which the members included in the fixing apparatus have an uneven cross-sectional configuration in the longitudinal direction will be described. FIG. 26 illustrates a fixing apparatus including a temperature detection member 240 inside the conductive layer (in the region between the magnetic core 2 and the conductive layer). Other than that, the fixing apparatus illustrated in FIG. 26 is configured similarly to the first exemplary embodiment, and includes a film 1 having the conductive layer, the magnetic core 2, and a nip portion formation member (a film guide) 9.

Where an X axis direction corresponds to the longitudinal direction of the magnetic core 2, a maximum image formation region is a range of 0 to $L_p$ on the X axis. For example, with respect to an image forming apparatus in which the maximum conveyance region for the recording material P is 215.9 mm that is a letter (LTR) size, $L_p$ can be set to 215.9 mm. The temperature detection member 240 is made of a non-magnetic body having a relative magnetic permeability of 1, and has a cross-sectional area of 5 mm×5 mm in a direction perpendicular to the X axis, and a length of 10 mm in a direction parallel to the X axis. The temperature detection member 240 is disposed at a position from $L_1$ (102.95 mm) to $L_2$ (112.95 mm) on the X axis. A region from 0 to $L_1$ represented by X coordinates is referred to as a region 1. A region from $L_1$ to $L_2$, where the temperature detection member 240 exists, is referred to as a region 2. A region from $L_2$ to $L_P$ is referred to as a region 3. FIG. 27A illustrates a cross-sectional configuration in the region 1, and FIG. 27B illustrates a cross-sectional configuration in the region 2. As illustrated in FIG. 27B, the temperature detection member 240 is contained in the film 1, and therefore is included in the magnetic resistance calculation. The following procedure is performed to strictly calculate the magnetic resistance. A "magnetic resistance per unit length" is calculated separately for each of the regions 1, 2, and 3. An integration calculation is performed according to a length of each region. Then, a combined magnetic resistance is calculated by adding them up.

First, the magnetic resistances of the respective members per unit length in the region 1 or 3 are indicated in a following table 3.

TABLE 3

| ITEM | UNIT | MAGNETIC CORE | FILM GUIDE | INSIDE CONDUCTIVE LAYER | CONDUCTIVE LAYER |
|---|---|---|---|---|---|
| CROSS-SECTIONAL AREA | m^2 | 1.5E−04 | 1.0E−04 | 2.0E−04 | 1.5E−06 |
| RELATIVE MAGNETIC PERMEABILITY | | 1800 | 1 | 1 | 1 |
| MAGNETIC PERMEABILITY | H/m | 2.3E−03 | 1.3E−06 | 1.3E−06 | 1.3E−06 |
| PERMEANCE PER UNIT LENGTH | H · m | 3.5E−07 | 1.3E−10 | 2.5E−10 | 1.9E−12 |
| MAGNETIC RESISTANCE PER UNIT LENGTH | 1/(H · m) | 2.9E+06 | 8.0E+09 | 4.0E+09 | 5.3E+11 |

A magnetic resistance $r_{c1}$ of the magnetic core 2 per unit length in the region 1 has the following value.

$$r_{c1}=2.9\times10^6[1/(H\cdot m)]$$

A magnetic resistance $r_a$ of the region between the conductive layer and the magnetic core 2 per unit length is a combined magnetic resistance that is a combination of a magnetic resistance $r_f$ of the film guide per unit length, and a magnetic resistance $r_{air}$ inside the conductive layer per unit length. Therefore, the magnetic resistance $r_a$ can be calculated with use of a following expression 36.

$$\frac{1}{r_a} = \frac{1}{r_f} + \frac{1}{r_{air}} \quad (36)$$

As a result of the calculation, a magnetic resistance $r_{a1}$ in the region 1 and a magnetic resistance $r_{s1}$ in the region 1 have the following values.

$$r_{a1}=2.7\times10^9[1/(H\cdot m)]$$

$$r_{s1}=5.3\times10^{11}[1/(H\cdot m)]$$

Further, the region 3 is similar to the region 1, so that the respective magnetic resistances have the following values.

$$r_{c3}=2.9\times10^6[1/(H\cdot m)]$$

$$r_{a3}=2.7\times10^9[1/(H\cdot m)]$$

$$r_{s3}=5.3\times10^{11}[1/(H\cdot m)]$$

Next, the magnetic resistances of the respective members per unit length in the region 2 are indicated in a following table 4.

TABLE 4

| ITEM | UNIT | MAGNETIC CORE c | FILM GUIDE | THERMISTOR | INSIDE CONDUCTIVE LAYER | CONDUCTIVE LAYER |
|---|---|---|---|---|---|---|
| CROSS-SECTIONAL AREA | m^2 | 1.5E−04 | 1.0E−04 | 2.5E−05 | 1.72E−04 | 1.5E−06 |
| RELATIVE MAGNETIC PERMEABILITY | | 1800 | 1 | 1 | 1 | 1 |
| MAGNETIC PERMEABILITY | H/m | 2.3E−03 | 1.3E−06 | 1.3E−06 | 1.3E−06 | 1.3E−06 |
| PERMEANCE PER UNIT LENGTH | H · m | 3.5E−07 | 1.3E−10 | 3.1E−11 | 2.2E−10 | 1.9E−12 |
| MAGNETIC RESISTANCE PER UNIT LENGTH | 1/(H · m) | 2.9E+06 | 8.0E+09 | 3.2E+10 | 4.0E+09 | 5.3E+11 |

A magnetic resistance $r_{a2}$ of the magnetic core 2 in the region 2 per unit length has the following value.

$$r_{c2}=2.9\times10^{6}[1/(H\cdot m)]$$

The magnetic resistance $r_a$ of the region between the conductive layer and the magnetic core 2 per unit length is a combined magnetic resistance that is a combination of the magnetic resistance $r_f$ of the film guide per unit length, a magnetic resistance $r_t$ of the thermistor 240 per unit length, and the magnetic resistance $r_{air}$ of air inside the conductive layer per unit length. Therefore, the magnetic resistance $r_a$ can be calculated with use of the following expression 37.

$$\frac{1}{r_a}=\frac{1}{r_t}+\frac{1}{r_f}+\frac{1}{r_{air}} \tag{37}$$

As a result of the calculation, a magnetic resistance $r_{a2}$ per unit length in the region 2 and a magnetic resistance $r_{s2}$ per unit length in the region 2 have the following values.

$$r_{a2}=2.7\times10^{9}[1/(H\cdot m)]$$

$$r_{s2}=5.3\times10^{11}[1/(H\cdot m)]$$

A calculation method for the region 3 is similar to the region 1, and therefore a description thereof is omitted here.

A reason why $r_{a1}=r_{a2}=r_{a3}$ holds regarding the magnetic resistance $r_a$ of the region between the conductive layer and the magnetic core 2 per unit length will be described now. In the magnetic resistance calculation for the region 2, the cross-sectional area of the thermistor 240 increases while the cross-sectional area of the air inside the conductive layer decreases. However, both of them have a relative magnetic permeability of 1, whereby the magnetic resistance does not change in the end regardless of whether the thermistor 240 exists. In other words, when only a non-magnetic body is disposed in the region between the conductive layer and the magnetic core 2, the calculation can maintain sufficient accuracy even when non-magnetic body is handled in a manner similar to the air in the magnetic resistance calculation. This is because the non-magnetic body has a relative magnetic permeability almost close to 1. However, if a magnetic body (nickel, iron, silicon steel, or the like) is disposed, the region where there is the magnetic body had better be calculated separately from other regions.

An integration of the magnetic resistance R [A/Wb(1/H)] as the combined magnetic resistance in the generatrix direction of the conductive layer can be calculated with respect to the magnetic resistances $r_1$, $r_2$, and $r_3$ [1/(H·m)] in the respective regions 1, 2, and 3, according to a following expression 38.

$$R=\int_0^{L_1} r_1\,dl+\int_{L_1}^{L_2} r_2\,dl+\int_{L_2}^{L_p} r_3\,dl= r_1(L_1-0)+r_2(L_2-L_1)+r_3(L_p-L_2) \tag{38}$$

Therefore, the magnetic resistance $R_0$ [H] of the core 2 in a section from one end to the other end of the maximum conveyance region for the recording material P can be calculated according to a following expression 39.

$$R_c=\int_0^{L_1} r_{c1}\,dl+\int_{L_1}^{L_2} r_{c2}\,dl+\int_{L_2}^{L_p} r_{c3}\,dl= r_{c1}(L_1-0)+r_{c2}(L_2-L_1)+r_{c3}(L_p-L_2) \tag{39}$$

Further, the combined magnetic resistance $R_a$ [H] of the region between the conductive layer and the magnetic core 2 in the section from the one end to the other end of the maximum conveyance region for the recording material P can be calculated according to a following expression 40.

$$R_a=\int_0^{L_1} r_{a1}\,dl+\int_{L_1}^{L_2} r_{a2}\,dl+\int_{L_2}^{L_p} r_{a3}\,dl= r_{a1}(L_1-0)+r_{a2}(L_2-L_1)+r_{a3}(L_p-L_2) \tag{40}$$

The combined magnetic resistance $R_s$ [H] of the conductive layer in the section from the one end to the other end of the maximum conveyance region for the recording material P can be calculated according to a following expression 41.

$$R_s=\int_0^{L_1} r_{s1}\,dl+\int_{L_1}^{L_2} r_{s2}\,dl+\int_{L_2}^{L_p} r_{s3}\,dl= r_{s1}(L_1-0)+r_{s2}(L_2-L_1)+r_{s3}(L_p-L_2) \tag{41}$$

The results of the above-described calculations performed for the respective regions are shown in a following table 5.

TABLE 5

| | REGION 1 | REGION 2 | REGION 3 | COMBINED MAGNETIC RESISTANCE |
|---|---|---|---|---|
| START POINT OF INTEGRATION [mm] | 0 | 102.95 | 112.95 | |
| END POINT OF INTEGRATION [mm] | 102.95 | 112.95 | 215.9 | |
| DISTANCE [mm] | 102.95 | 10 | 102.95 | |
| PERMEANCE $p_c$ PER UNIT LENGTH [H · m] | 3.5E−07 | 3.5E−07 | 3.5E−07 | |
| MAGNETIC RESISTANCE $r_c$ PER UNIT LENGTH [1/(H · m)] | 2.9E+06 | 2.9E+06 | 2.9E+06 | |
| INTEGRATION OF MAGNETIC RESISTANCE $r_c$ [A/Wb(1/H)] | 3.0E+08 | 2.9E+07 | 3.0E+08 | 6.2E+08 |
| PERMEANCE $p_a$ PER UNIT LENGTH [H · m] | 3.7E−10 | 3.7E−10 | 3.7E−10 | |
| MAGNETIC RESISTANCE $r_a$ PER UNIT LENGTH [1/(H · m)] | 2.7E+09 | 2.7E+09 | 2.7E+09 | |
| INTEGRATION OF MAGNETIC RESISTANCE $r_a$ [A/Wb(1/H)] | 2.8E+11 | 2.7E+10 | 2.8E+11 | 5.8E+11 |
| PERMEANCE $p_s$ PER UNIT LENGTH [H · m] | 1.9E−12 | 1.9E−12 | 1.9E−12 | |
| MAGNETIC RESISTANCE $r_s$ PER UNIT LENGTH [1/(H · m)] | 5.3E+11 | 5.3E+11 | 5.3E+11 | |
| INTEGRATION OF MAGNETIC RESISTANCE $r_s$ [A/Wb(1/H)] | 5.4E+13 | 5.3E+12 | 5.4E+13 | 1.1E+14 |

According to the table 5 provided above, the magnetic resistances $R_c$, $R_a$, and $R_s$ have the following values.

$$R_c=6.2\times10^8[1/H]$$

$$R_a=5.8\times10^{11}[1/H]$$

$$R_s=1.1\times10^{14}[1/H]$$

The combined magnetic resistance $R_{sa}$ as a combination of the magnetic resistances $R_s$ and $R_a$ can be calculated according to a following expression 42.

$$\frac{1}{R_{sa}}=\frac{1}{R_s}+\frac{1}{R_a} \tag{42}$$

$$R_{sa}=\frac{R_a\times R_s}{R_a+R_s}$$

From the above-described calculation, $R_{sa}=5.8\times10^{11}$ [1/H] is acquired as the combined magnetic resistance $R_{sa}$, and therefore a following expression 43 is satisfied.

$$0.28\times R_{sa}\geq Rc \tag{43}$$

In this manner, in the fixing apparatus having an uneven cross-sectional shape in the generatrix direction of the conductive layer, the permeance or the magnetic resistance can be calculated by dividing the fixing apparatus into a plurality of regions in the generatrix direction of the conductive layer, calculating the permeance or the magnetic resistance for each of the regions, and lastly calculating the combined permeance or the combined magnetic resistance as a combination of them. However, if a target member is a non-magnetic body, the permeance or the magnetic resistance may be calculated by seeing the non-magnetic body as air, since the magnetic permeability of the non-magnetic body is substantially equal to the magnetic permeability of air. Next, a member that should be included in the above-described calculation will be described. It is desirable to calculate the permeance or the magnetic resistance with respect to a member located in the region between the conductive layer and the magnetic core 2 and having at least a part thereof located within the maximum conveyance region (0 to $L_p$ of the recording medium P. Conversely, the permeance or the magnetic resistance does not have to be calculated with respect to a member located outside the conductive layer. This is because the induced electromotive force is proportional to a temporal change in the magnetic flux perpendicularly penetrating through the circuit according to Faraday's law as described above, and is unrelated to the magnetic flux outside the conductive layer. Further, a member disposed outside the maximum conveyance region of the recording material P in the generatrix direction of the conductive layer does not affect the heat generation of the conductive layer, and therefore does not have to be included in the calculation.

3. Control of Fixing Apparatus

As illustrated in FIG. 2, temperature detection members 9, 10, and 11 are disposed at positions facing the outer circumferential surface of the fixing sleeve 1 on an upstream side of the nip portion N in the rotational direction of the fixing sleeve 1. As illustrated in FIG. 3, the temperature detection member 9 is disposed at a position facing a central portion of the fixing sleeve 1 in the generatrix direction of the fixing sleeve 1, and the temperature detection members 10 and 11 are disposed at positions facing the both ends of the fixing sleeve 1 in the generatrix direction of the fixing sleeve 1, respectively. Each of the temperature detection members 9, 10, and 11 includes a non-contact type thermistor or the like.

Next, FIG. 4 is a block diagram of a printer control unit 40. A power control unit 46 controls power supplied to the fixing apparatus A in such a manner that a temperature detected by the temperature detection member 9 matches a target temperature. Further, the temperature detection members 10 and 11 are used to monitor a temperature in a so-called non-sheet-passing region which the recording material P does not pass through when data is continuously printed onto the recording material P having a small size. The power control unit 46 also detects an abnormality of the fixing apparatus A based on the temperatures detected by the temperature detection members 9, 10, and 11. A printer controller 41 performs communication with and receives image data from a host computer 42 that will be described below, and develops the received image data into information that the printer can print. The printer controller 41 also exchanges a signal and performs serial communication with an engine control unit 43. The engine control unit 43 exchanges a signal with the printer controller 41, and further controls a frequency control unit 45 and the power control unit 46 via serial communication. The frequency control unit 45 controls a driving frequency of the high-frequency converter 16, and the power control unit 46 adjusts a voltage applied to the exciting coil 3 and controls power of the high-frequency converter 16. Further, the host computer 42 transfers the image data to the printer controller 41, and sets various printing conditions such as the size of the recording material P to the printer controller 41 according to a request from a user.

4. Heat Generation Drop in Fixing Apparatus Having Magnetic Core Including Plurality of Divided Cores A heat generation drop that occurs when the magnetic core 2 is divided, with the exciting coil 3 wound around the magnetic core 2 at a predetermined interval, will be described as a comparative example 1, to make a comparison with the first exemplary embodiment that will be described below.

Figures 7A, 7B:
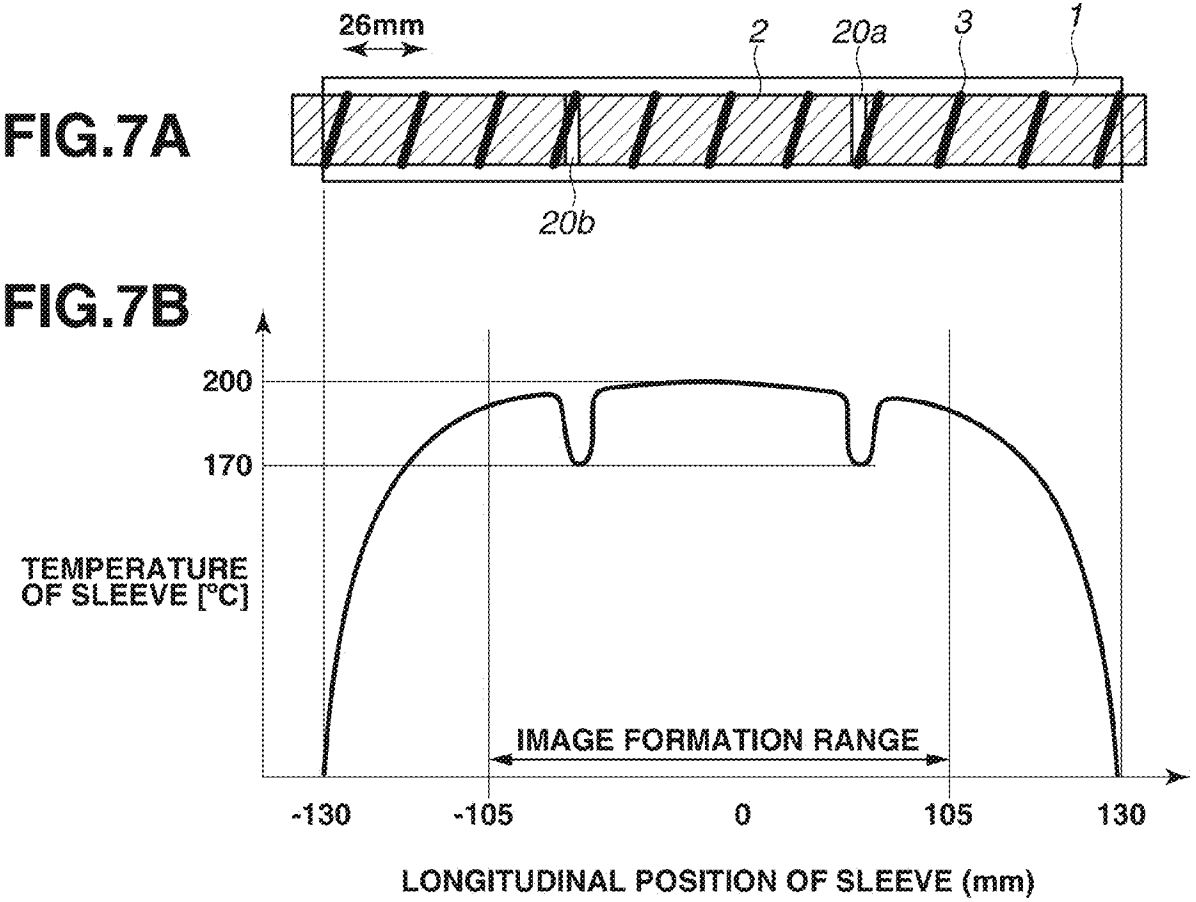
FIG. 7A is a front view of a comparative example 1.
FIG. 7B illustrates a heat generation distribution of a fixing sleeve according to the comparative example 1.

FIG. 7A is a front view illustrating the fixing sleeve 1, the magnetic core 2, and the exciting coil 3 according to the comparative example 1. Further, FIG. 7B illustrates a heat generation distribution of the fixing sleeve 1 in the generatrix direction thereof.

The material of the magnetic core 2 is desirably a material having a small hysteresis loss and a high relative magnetic permeability, such as calcined ferrite, ferrite resin, and an amorphous alloy, or a ferromagnetic material including an oxidized material or an alloy material having a high magnetic permeability such as a permalloy. In the present embodiment, calcined ferrite having a relative magnetic permeability of 1800 is used for the magnetic core 2. The magnetic core 2 has a columnar shape having a diameter of 5 to 30 mm, and has a length of 280 mm in the longitudinal direction.

The magnetic core 2 includes a plurality of divided cores as illustrated in FIG. 7A to prevent the magnetic core 2 from being broken when an impact is applied to the fixing apparatus A. In the divided cores according to the present exemplary embodiment, the magnetic core 2 is divided into three pieces having equal lengths, but the number of pieces into which the magnetic core 2 is divided, and the lengths of the divided cores are not limited to the configuration according to the present exemplary embodiment.

The divided cores are arranged in the helically shaped portion of the exciting coil 3 in the generatrix direction of the fixing sleeve 1 with a predetermined interval. A region of the magnetic core 2 where the interval is formed (a region corresponding to a boundary between the divided cores) is referred to as a division region. Both the intervals of two division regions (20*a* and 20*b*) illustrated in FIG. 7A are 100 μm. Further, adjacent turns of the exciting coil 3 are spaced apart from each other by a predetermined interval of 26 mm, and eleven turns are wound around the magnetic core 2.

Figure 8:
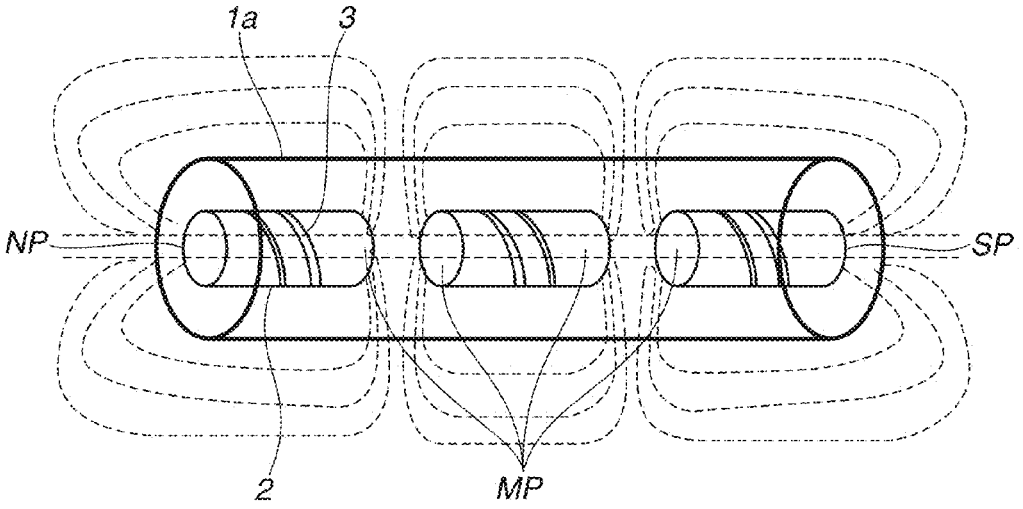
FIG. 8 illustrates how lines of magnetic force pass through a magnetic core.

Next, a configuration for holding the plurality of divided cores and unitizing them as the magnetic core 2 will be described. In the present exemplary embodiment, in a magnetic core, a PET sheet is inserted between the divided cores and is adhered therebetween to form the division regions (20*a* and 20*b*) having the interval of 100 μm. In addition to the configuration according to the present exemplary embodiment, a core holder (not illustrated) for holding the plurality of divided cores may be provided at the predetermined interval as another possible configuration. According to the present configuration, the exciting coil 3 is wound around the outer side of the core holder. In the present exemplary embodiment, the division regions 20*a* and 20*b* are PET sheets, and have far lower magnetic permeabilities than the magnetic core 2. Therefore, as illustrated in FIG. 8, magnetic poles are also produced at portions MP other than the both ends NP and SP of the magnetic core 2, and the number of the magnetic lines penetrating through the heat generation layer 1*a* in the generatrix direction of the fixing sleeve 1 decreases at the division regions 20*a* and 20*b*. Therefore, at the division regions 20*a* and 20*b*, the magnetic flux $\Delta\phi$ represented by the expression 1 is small, and the electromotive force V produced on the fixing sleeve 1 is also weak.

The decrease in the electromotive force produced on the fixing sleeve 1 causes such a phenomenon that the temperature decreases at regions of the fixing sleeve 1 that correspond to the division regions 20*a* and 20*b* (this phenomenon will be hereinafter referred to as a heat generation drop), as illustrated in FIG. 7B. In the distribution illustrated in FIG. 7B, the temperature of the fixing sleeve 1 decreases to 170° C. at the regions where the heat generation drops occur while power is controlled in such a manner that the temperature of the fixing sleeve 1 is adjusted to 200° C.

6. How to Wind Exciting Coil According to Present Exemplary Embodiment

Figures 9A, 9B:
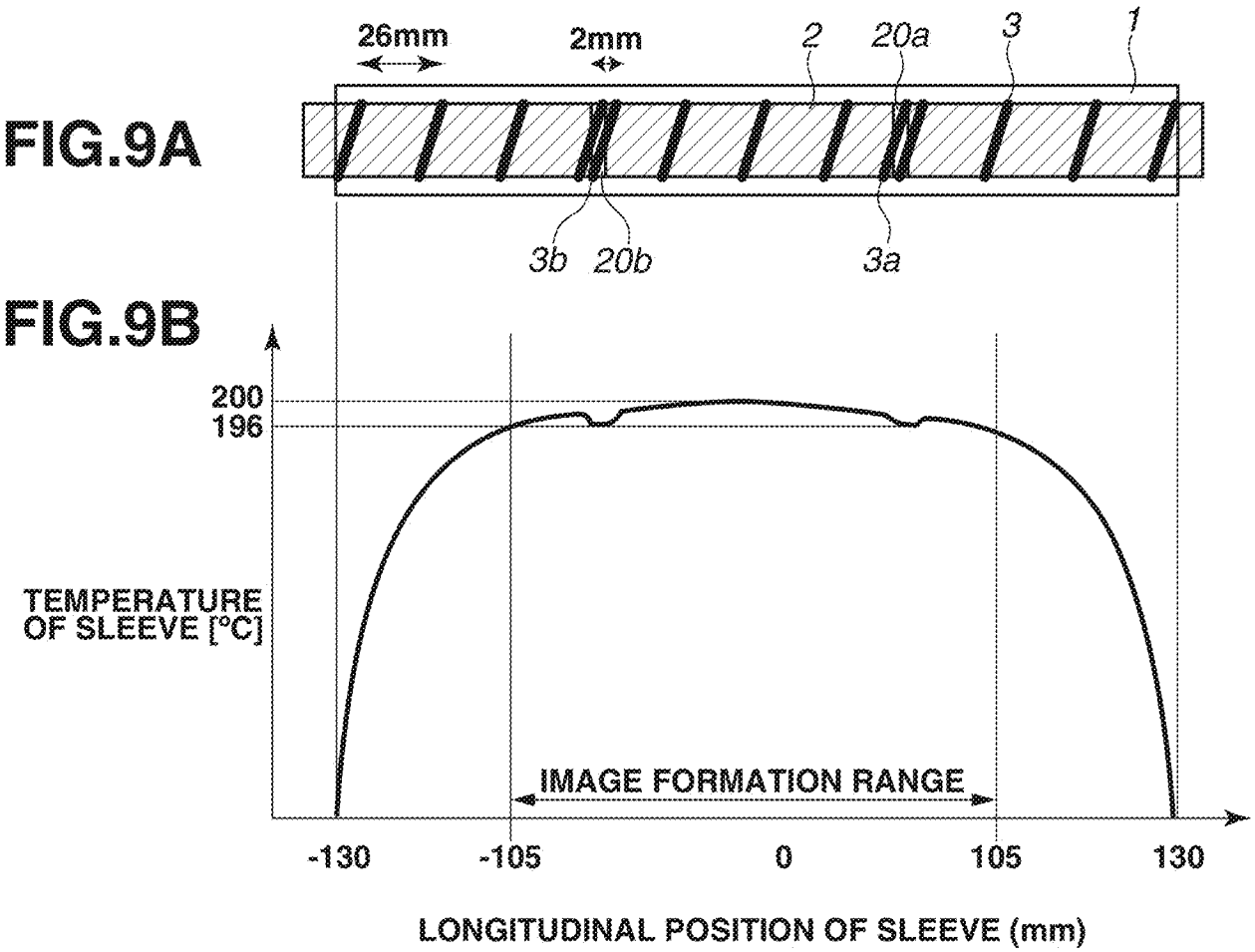
FIG. 9A is a front view of a first exemplary embodiment.
FIG. 9B illustrates a heat generation distribution of the fixing sleeve according to the first exemplary embodiment.

A configuration according to the first exemplary embodiment will be described. FIG. 9A is a front view illustrating the fixing sleeve 1, the magnetic core 2, and the exciting coil 3 according to the first exemplary embodiment. The same reference numerals are assigned to the members and the regions that work in a similar manner to the comparative example 1 illustrated in FIG. 7A. Further, FIG. 9B illustrates a heat generation distribution of the fixing sleeve 1 in the longitudinal direction thereof according to the first exemplary embodiment.

The first exemplary embodiment is different from the comparative example 1 only in a method of winding the exciting coil 3, and is similar to the comparative example 1 in terms of the materials and the dimensions of the other components. The first exemplary embodiment is similar to the comparative example 1 in terms of the configuration in which adjacent turns of the exciting coil 3 are spaced apart from each other by the predetermined interval of 26 mm, and eleven turns are wound around the magnetic core 2. A difference of the first exemplary embodiment from the comparative example 1 is that the number of turns increases by one turn at regions corresponding to the division regions 20*a* and 20*b* spaced apart from the adjacent turn at an interval of 2 mm, like turns 3*a* and 3*b*, so that there are thirteen turns in total. In other words, the first exemplary embodiment is characterized in that the number of turns of the coil 3 per unit length is larger at the region corresponding to the boundary between the divided cores than the number of turns of the coil 3 at regions corresponding to regions other than the boundary.

In this manner, the first exemplary embodiment can compensate for the decrease in the number of the magnetic lines penetrating through the inside of the heat generation layer 1*a* (the hollow portion) at the division regions 20*a* and 20*b* by increasing the number of turns of the exciting coil 3 at the division regions 20*a* and 20*b*. According to the above-described expression 1, the electromotive force V induced on the fixing sleeve 1 is enhanced by increasing the N (the number of turns of the coil 3) at the division regions 20*a* and 20*b*. As a result, as illustrated in FIG. 9B, the heat generation drops, at which the temperature of the fixing sleeve 1 decreases at the same longitudinal positions as the division regions 20*a* and 20*b*, are reduced compared to the comparative example 1. In the distribution illustrated in FIG. 9B, the temperature of the fixing sleeve 1 is adjusted to 200° C., and decreases to 196° C. at the portions where the heat generation drops occur.

7. Effect of First Exemplary Embodiment

A table 6 summarizes the configurations according to the comparative example 1 and the first exemplary embodiment, and existence or absence of an image defect. The number of turns of the exciting coil 3 wound around each of the division regions 20*a* and 20*b* is listed as the number of turns per unit length at the division regions 20*a* and 20*b*.

An image defect was detected in the following manner. A sheet having an A4 size and a grammage of 80 g/m$^2$ was used as the recording material P. Images were successively printed onto ten sheets with the temperature of the fixing sleeve 1 adjusted to 200° C., and the images formed on the recording materials P were visually checked. The recording materials P were conveyed at a speed of 300 mm/sec, and a distance between preceding and subsequent materials P is 40 mm.

TABLE 6

| | NUMBER OF TURNS (TURNS) | NUMBER OF TURNS AT DIVISION REGION (TURNS/ 100 μm) | TEMPERATURE OF FIXING SLEEVE 1 AT DIVISION REGION (° C.) | IMAGE DEFECT |
|---|---|---|---|---|
| COMPARATIVE EXAMPLE 1 | 11 | 1 | 170 | FIXING DEFECT DETECTED |
| FIRST EXEMPLARY EMBODIMENT | 13 | 2 | 196 | NONE |

In the following description, occurrence of an image defect due to the decrease in the temperature of the fixing sleeve 1 according to the heat generation drop will be described. As a condition this time, the employed toner is such toner that a fixing defect occurs when the temperature of the fixing sleeve 1 is 185° C. or lower, and a hot offset occurs when the temperature of the fixing sleeve is 205° C. or higher. The fixing defect described here means fixing unevenness that occurs due to an uneven squash of the toner, and glossiness and fixability were evaluated. Further, the hot offset means an image defect that the temperature of the fixing sleeve 1 is high and therefore excessively melts the toner, and the excessively melted toner is attached to the fixing sleeve 1 and is transferred and fixed onto the recording material P after one rotation of the fixing sleeve 1 to thereby dirty the recording material P.

In the comparative example 1, the temperature of the fixing sleeve 1 is 170° C., which is a low temperature, and therefore causes a fixing defect at the portions where the heat generation drops occur. On the other hand, in the first exemplary embodiment, the temperature of the fixing sleeve 1 is 196° C., which is a sufficiently high temperature, and therefore does not cause a fixing defect at the portions even where the heat generation drops occur so that an excellent image can be acquired.

Figure 10:
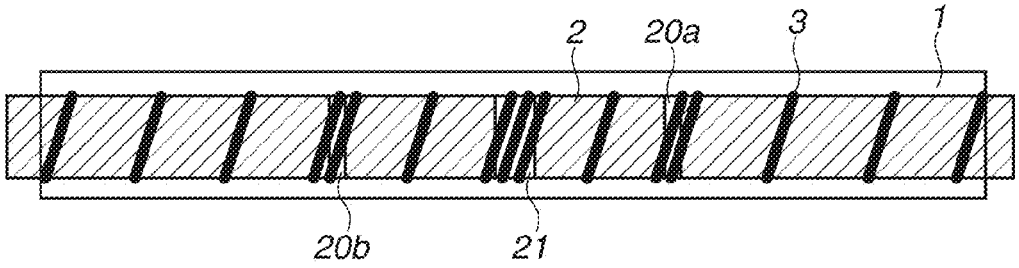
FIG. 10 illustrates a winding method of an exciting coil 3 when division regions have different intervals.

Even if the division regions 20*a* and 20*b* have different intervals, the first exemplary embodiment can reduce the heat generation drops by adjusting a method of winding the exciting coil 3 in a similar manner. For example, in a configuration in which the magnetic core 2 includes three or more divided cores, and a division region has a longer interval (a first interval) than the intervals of the division regions 20*a* and 20*b* (a second interval) as illustrated in FIG. 10, the method of winding the exciting coil 3 will be described now. In the present configuration, it is possible to reduce the heat generation drops by winding the exciting coil 3 in such a manner that the number of turns of the exciting coil 3 becomes larger at the division region 21 than at the division regions 20*a* and 20*b*.

The configuration according to the present exemplary embodiment can be also employed even for a magnetic core configured in such a manner that end surfaces of the divided cores are brought into direct contact with each other or are directly adhered to each other without an interval formed between the divided cores, because a gap exists at the boundary between the divided cores depending on surface accuracy of the divided cores.

8. Method of Winding Exciting Coil According to Comparative Example 2

A heat generation drop occurs when the magnetic core 2 is divided into four pieces, the exciting coil 3 is wound densely at the ends and is wound sparsely at the central portion in the generatrix direction of the fixing sleeve 1. Such a case will be described below as a comparative example 2, to compare it with a second exemplary embodiment that will be described below.

Figures 11A, 11B:
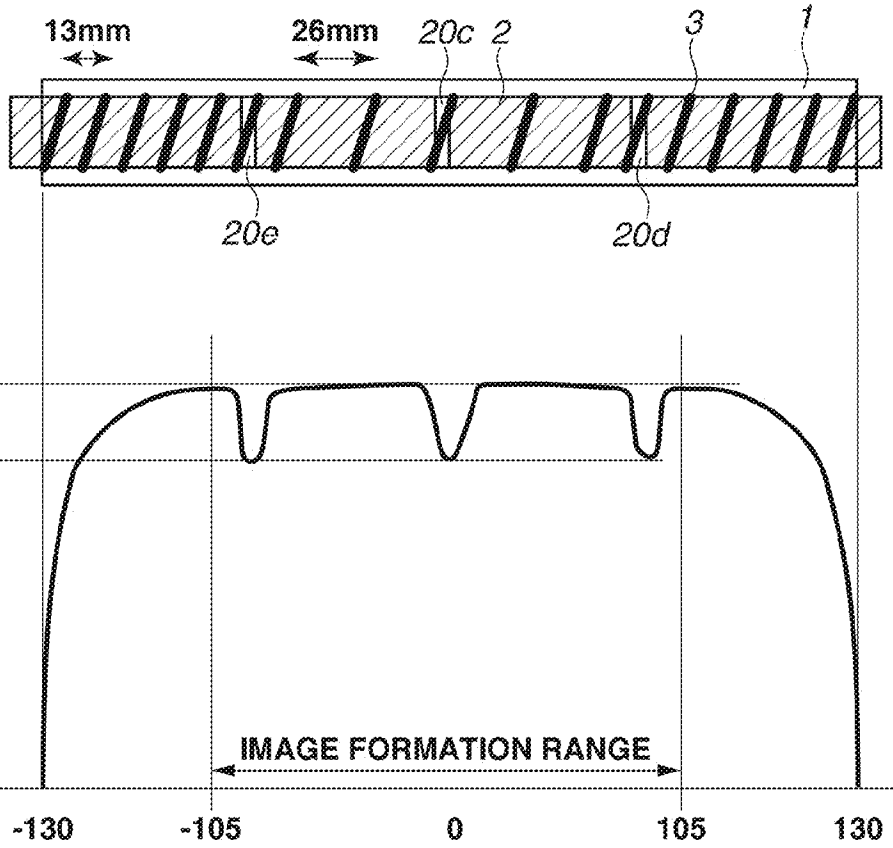
FIG. 11A is a front view of a comparative example 2.
FIG. 11B illustrates a heat generation distribution of the fixing sleeve according to the comparative example 2.

FIG. 11A is a front view illustrating the fixing sleeve 1, the magnetic core 2, and the exciting coil 3 according to the comparative example 2. The same reference numerals are assigned to the members and the regions that work in a similar manner to the comparative example 1 illustrated in FIG. 7A, and members and regions that will not be described below are configured similar to the comparative example 1. Further, FIG. 11B illustrates a heat generation distribution of the fixing sleeve 1 in the longitudinal direction thereof.

As illustrated in FIG. 11A, the magnetic core 2 is evenly divided into four pieces, and division regions 20*c*, 20*d*, and 20*e* of the divided magnetic core 2 each have an interval of 80 μm. Further, the exciting coil 3 is wound in such a manner that adjacent turns are spaced apart from each other by a constant interval of 26 mm at the central portion in the longitudinal direction while adjacent turns are spaced apart from each other by a constant interval of 13 mm at the ends in the longitudinal direction, and seventeen turns in total are wound around the magnetic core 2.

As illustrated in FIG. 11B, heat generation drops occur which causes decrease in the temperature of the fixing sleeve 1 corresponding to the division regions 20*c*, 20*d*, and 20*e*. In the distribution illustrated in FIG. 11B, the temperature of the fixing sleeve 1 decreases to 177° C. at portions where the heat generation drops occur, although power is controlled in such a manner that the temperature of the fixing sleeve 1 is maintained at 200° C.

Figures 12A, 12B:
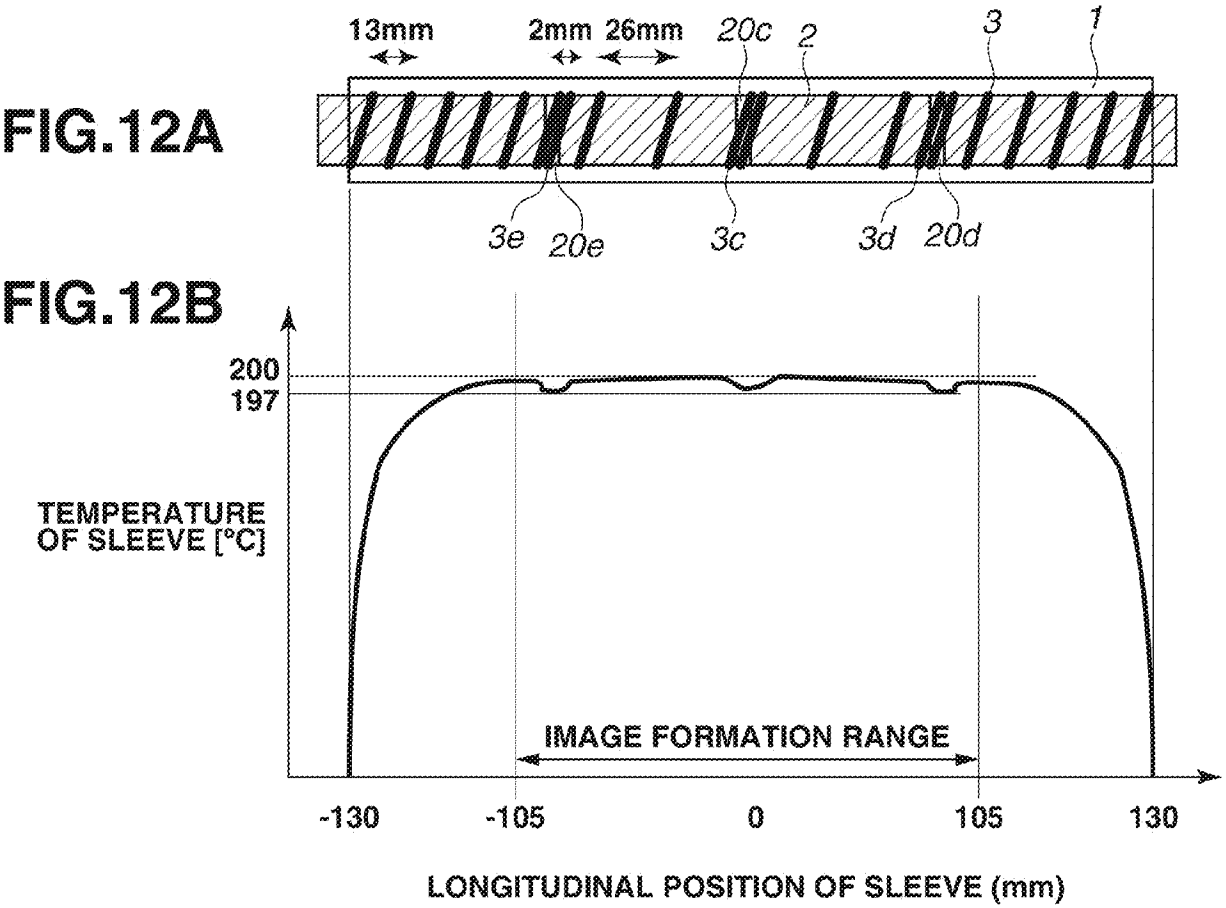
FIG. 12A is a front view of a second exemplary embodiment.
FIG. 12B illustrates a heat generation distribution of the fixing sleeve according to the second exemplary embodiment.

9. A Method of Winding Exciting Coil According to Second Exemplary Embodiment In this section, a configuration according to the present exemplary embodiment will be described. FIG. 12A is a front view illustrating the fixing sleeve 1, the magnetic core 2, and the exciting coil 3 according to the second exemplary embodiment. The same reference numerals are assigned to the members and the regions that work in a similar manner to the comparative example 2 illustrated in FIG. 11A. Further, FIG. 12B illustrates a heat generation distribution of the fixing sleeve 1 in the longitudinal direction thereof according to the second exemplary embodiment.

The second exemplary embodiment is different from the comparative example 2 only in a method of winding the exciting coil 3, and is similar to the comparative example 2 in terms of the materials and the dimensions of the other components. In the second exemplary embodiment, the exciting coil 3 is wound around the magnetic core 2 by seventeen turns, in a similar manner to the comparative example 2. Further, in the second exemplary embodiment, the number of turns increases by one turn at each of the division regions 20*c*, 20*d*, and 20*e* with these additional turns spaced apart from the adjacent turn at an interval of 2 mm, as seen in turns 3*c*, 3*d*, and 3*e*, so that there are twenty turns in total.

In the second exemplary embodiment, as illustrated in FIG. 12B, the heat generation drops, which cause the decreases in the temperature of the fixing sleeve 1 corresponding to the division regions 20*c*, 20*d*, and 20*e*, are reduced compared to the comparative example 2. In the distribution illustrated in FIG. 12B, the temperature of the fixing sleeve 1 is adjusted to 200° C., and decreases to 197° C. at the portions where the heat generation drops occur.

10. Effect of Second Exemplary Embodiment

A table 7 summarizes the above-described configurations according to the comparative example 2 and the second exemplary embodiment, and existence or absence of an image defect. The number of turns of the exciting coil 3 wound around each of the division regions 20*c*, 20*d*, and 20*e* is listed as the number of turns per unit length at the division regions 20*c*, 20*d*, and 20*e*. The method and condition for checking an image defect are similar to the first exemplary embodiment.

TABLE 7

| | NUMBER OF TURNS (TURNS) | NUMBER OF TURNS AT DIVISION REGION (TURNS/ 80 μm) | TEMPERATURE OF FIXING SLEEVE 1 AT DIVISION REGION (° C.) | IMAGE DEFECT |
|---|---|---|---|---|
| COMPARATIVE EXAMPLE 2 | 17 | 1 | 177 | FIXING DEFECT DETECTED |
| SECOND EXEMPLARY EMBODIMENT | 20 | 2 | 197 | NONE |

In the comparative example 2, the temperature of the fixing sleeve 1 is 170° C., which is a low temperature, and therefore causes a fixing defect at the portions where the heat generation drops occur. On the other hand, in the second exemplary embodiment, the temperature of the fixing sleeve 1 is 197° C., which is a sufficiently high temperature, and therefore does not cause a fixing defect at the portions where the heat generation drops occur, so that an excellent image can be acquired.

Even if the division regions 20*c*, 20*d*, and 20*e* have different intervals, according to the second exemplary embodiment, the heat generation drops can be reduced by adjusting a method of winding the exciting coil 3 in a similar manner. More specifically, if the division region 20*c* has a longest interval, it is possible to reduce the heat generation drop and prevent or decrease occurrence of an image defect, by increasing the number of turns of the exciting coil 3 in the vicinity of the division region 20*c*. Further, while there are three division regions in the second exemplary embodiment, it is also possible to reduce the heat generation drops by adjusting the method of winding the exciting coil 3 in a similar manner even if there are more than three division regions As described above, the second exemplary embodiment can reduce the heat generation drops that occur at the division regions 20*c*, 20*d*, and 29*e* of the magnetic core 2, thereby preventing or reducing occurrence of an image defect such as a fixing defect.

Figures 13A, 13B:
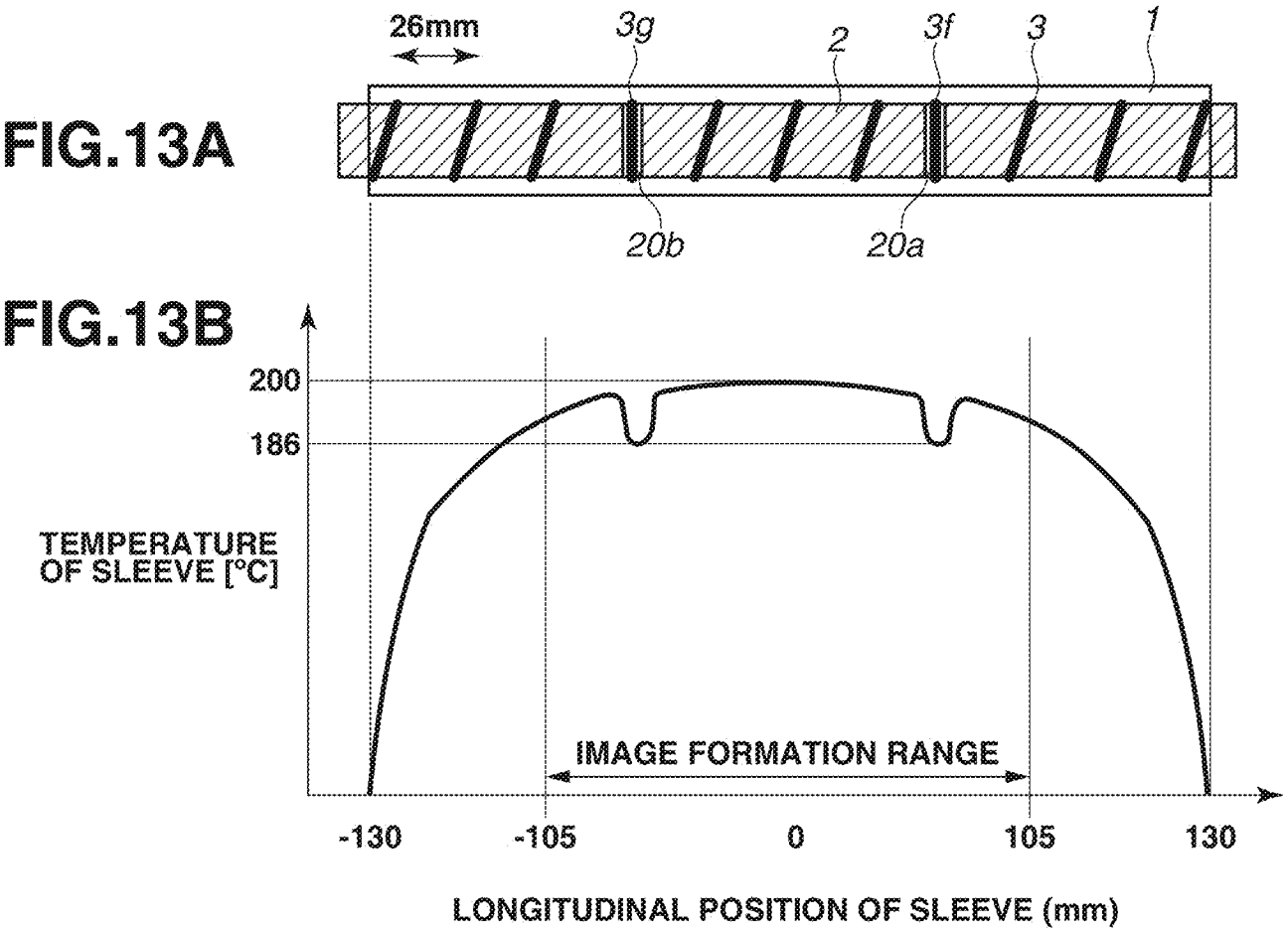
FIG. 13A is a front view of a third exemplary embodiment.
FIG. 13B illustrates a heat generation distribution of the fixing sleeve according to the third exemplary embodiment.

FIG. 13A is a front view illustrating the fixing sleeve 1, the magnetic core 2, and the exciting coil 3 according to a third exemplary embodiment. The same reference numerals are assigned to the members and the regions that work in a similar manner to the comparative example 1 illustrated in FIG. 7A. Further, FIG. 13B illustrates a heat generation distribution of the fixing sleeve 1 in the generatrix direction according to the third exemplary embodiment.

The third exemplary embodiment is different from the configuration according to the comparative example 1 illustrated in FIG. 7A in terms of a direction in which the exciting coil 3 is wound at the division regions 20*a* and 20*b*. More specifically, as indicated by turns 3*f* and 3*g* illustrated in FIG. 13A, the exciting coil 3 is wound at the division regions 20*a* and 20*b* perpendicular to the generatrix direction of the fixing sleeve 1, and wound obliquely with respect to the generatrix direction of the fixing sleeve 1 at other regions than the division regions 20*a* and 20*b*. On the other hand, in the comparative example 1, the exciting coil 3 is wound not only at the division regions 20*a* and 20*b* but also at the other regions obliquely with respect to the generatrix direction of the fixing sleeve 1.

A table 8 summarizes the above-described configurations according to the comparative example 1 and the third exemplary embodiment, and existence or absence of an image defect. The method and condition for checking an image defect are similar to the first exemplary embodiment.

TABLE 8

| | NUMBER OF TURNS (TURNS) | METHOD OF WINDING EXCITING COIL 3 AT DIVISION REGION | TEMPERATURE OF FIXING SLEEVE 1 AT DIVISION REGION (° C.) | IMAGE DEFECT |
|---|---|---|---|---|
| COMPARATIVE EXAMPLE 1 | 11 | WOUND OBLIQUELY WITH RESPECT TO GENERATRIX DIRECTION OF FIXING SLEEVE | 170 | FIXING DEFECT DETECTED |
| THIRD EXEMPLARY EMBODIMENT | 11 | WOUND PERPENDICULAR TO GENERATRIX DIRECTION OF FIXING SLEEVE | 186 | NONE |

In the comparative example 1, the temperature of the fixing sleeve 1 is 170° C., which is a low temperature, and therefore causes a fixing defect at the portions where the heat generation drops occur. On the other hand, in the third exemplary embodiment, the temperature of the fixing sleeve 1 is 186° C., and therefore does not cause a fixing defect at the portions where the heat generation drops occur so that an excellent image can be acquired.

The heat generation drops are reduced by winding the exciting coil 3 at the division regions 20*a* and 20*b* in the manner according to the third exemplary embodiment, for a reason that will be described qualitatively below.

Figure 14:
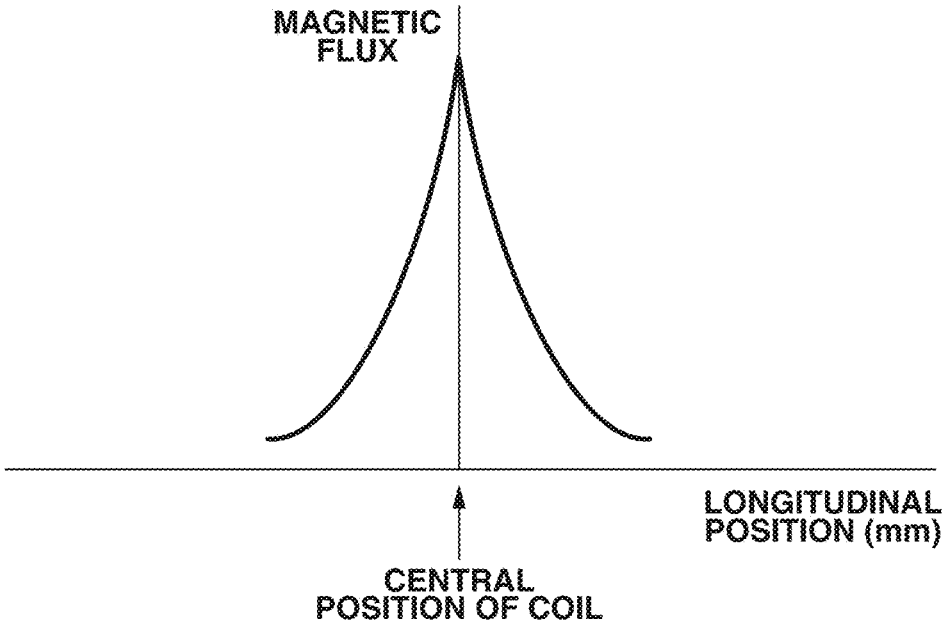
FIG. 14 illustrates a magnetic flux distribution produced by the exciting coil per unit length.

FIG. 14 illustrates a magnetic flux distribution in the longitudinal direction, which the exciting coil 3 produces in the magnetic core 2 per unit length. In this distribution, there is a peak at the central position of the coil 3, and the magnetic flux decreases as it gets farther away from the center of the coil 3. This magnetic flux distribution can be also derived from the Biot-Savart law, which is a law of electromagnetism for calculating a magnetic field produced according to a magnitude, a distance, and a direction of a current.

Figure 15A:
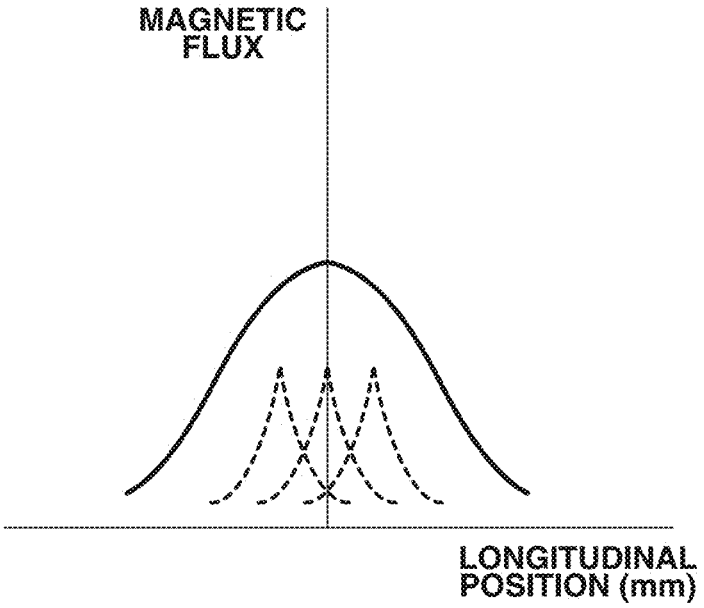
FIGS. 15A and 15B illustrate a magnetic flux distribution produced by the exciting coil according to the comparative example 1.
Figure 15B:
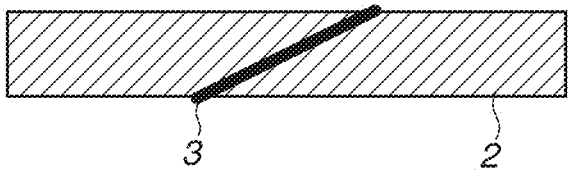
Figure 16A:
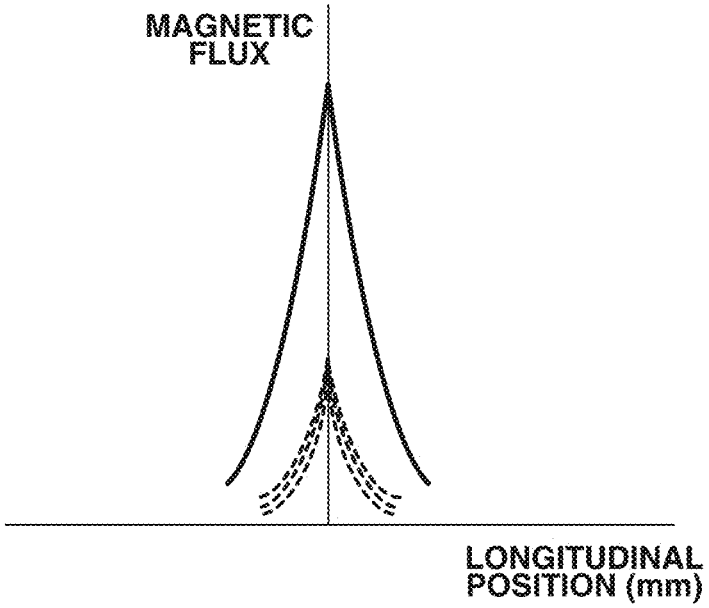
FIGS. 16A and 16B illustrate a magnetic flux distribution produced by the exciting coil according to the third exemplary embodiment.
Figure 16B:
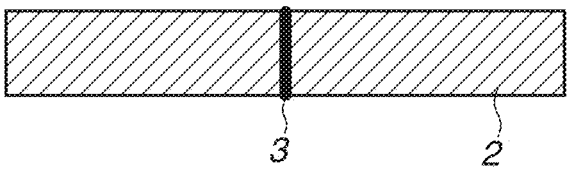

FIG. 15A is an image diagram of a magnetic flux distribution according to the comparative example 1. FIG. 15B is an image diagram illustrating the magnetic core 2 and the exciting coil 3 according to the comparative example 1 in an enlarged manner. Further, FIG. 16A illustrates an image diagram of a magnetic flux distribution according to the third exemplary embodiment. FIG. 16B is an image diagram illustrating the magnetic core 2 and the exciting coil 3 according to the third exemplary embodiment in an enlarged manner.

As illustrated in FIG. 15B, in the comparative example 1, the exciting coil 3 is obliquely wound. Further, the exciting coil 3 produces FIG. 14 illustrates a distribution of the magnetic flux per unit length. Therefore, in the comparative example 1, there are magnetic flux peaks of the exciting coil 3 at several positions in the longitudinal direction, as indicated by dotted lines in FIG. 15A. In FIG. 15A, the peaks are represented as three peaks for the reason of limited space in the drawing. A combination of all of these distributions constitutes the distribution of the magnetic flux produced by the exciting coil 3 in the comparative example 1, which is indicated by a solid line in FIG. 15A.

On the other hand, as illustrated in FIG. 16B, in the third exemplary embodiment, the exciting coil 3 is perpendicularly wound. Further, a distribution of the magnetic flux which the exciting coil 3 produces per unit length is illustrated in FIG. 14. Therefore, in the third exemplary embodiment, there are magnetic flux peaks of the exciting coil 3 at same positions in the longitudinal direction, as indicated by dotted lines in FIG. 16A. FIG. 16A illustrates only three distributions as representatives for the reason of limited space in the drawing. A combination of all of these distributions constitutes the distribution of the magnetic flux produced by the exciting coil 3 in the third exemplary embodiment, which is indicated by a solid line in FIG. 16A.

If the solid line illustrated in FIG. 15A and the solid line illustrated in FIG. 16A are compared, it can be seen that more magnetic fluxes can be produced at the center of the exciting coil 3 in FIG. 16A. Therefore, winding the exciting coil 3 according to the third exemplary embodiment can produce more magnetic fluxes at the division regions 20*a* and 20*b*, and therefore can reduce the heat generation drops.

Figure 17:
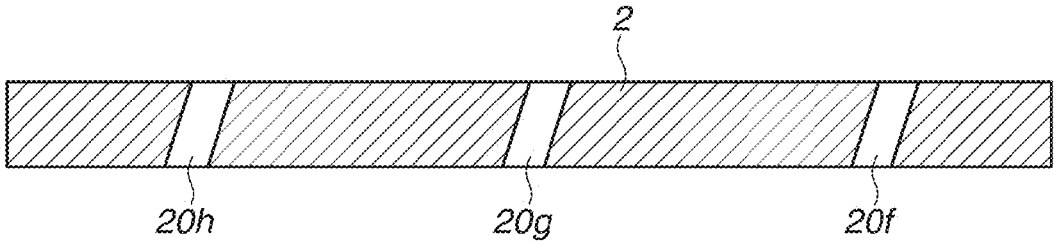
FIG. 17 illustrates the magnetic core when it is divided obliquely.

According to the third exemplary embodiment, even if the division regions 20*a* and 20*b* have shapes different from the above-described example, the heat generation drops can be reduced by adjusting a method of winding the exciting oil 3 in a similar manner. More specifically, the third exemplary embodiment can be also employed even if the division regions 20*a* and 20*b* have such surface shapes that the magnetic core 2 is obliquely divided as indicated by division regions 20*f*, 20*g*, and 20*h* illustrated in FIG. 17 instead of being perpendicularly divided. In this case, it is possible to reduce the heat generation drops to prevent or decrease occurrence of an image defect, by winding the exiting coil 3 so as to cover the surface shapes of the obliquely formed division regions 20*f*, 20*g*, and 20*h*.

As described above, the third exemplary embodiment can reduce the heat generation drops that occur at the division regions 20*a* and 20*b* of the magnetic core 2, thereby preventing or reducing occurrence of an image defect such as a fixing defect.

Figure 18:
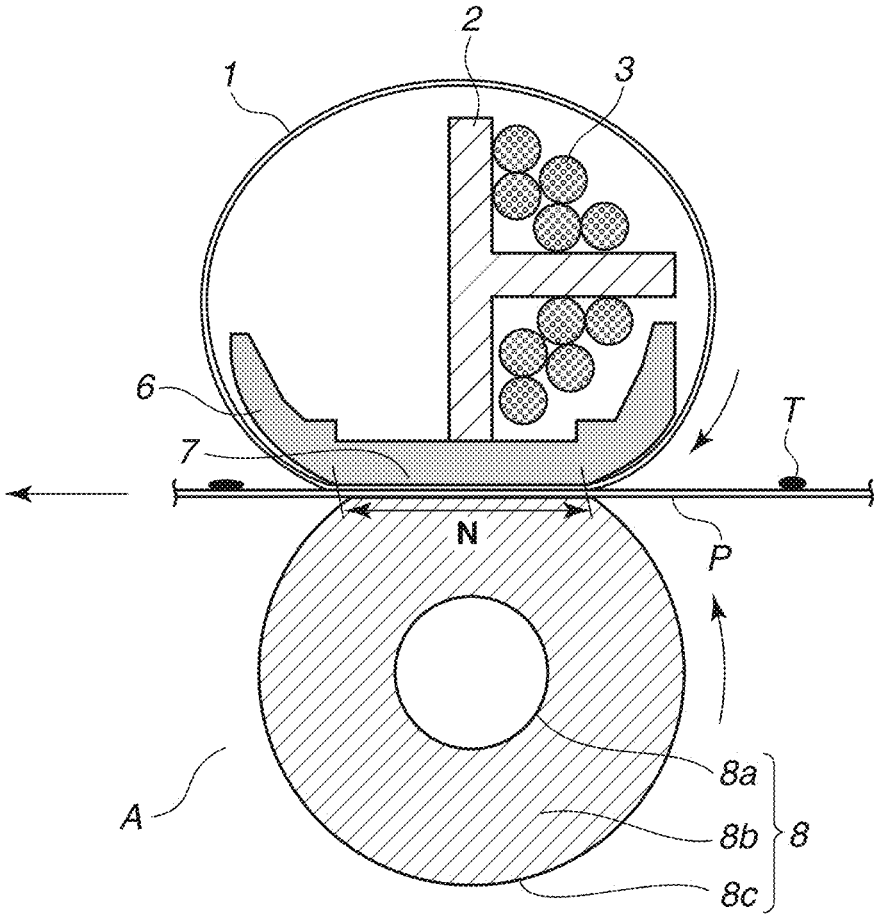
FIG. 18 is a cross-sectional view of a fixing apparatus according to a fourth exemplary embodiment.

A fourth exemplary embodiment is a so-called induction heating (IH) type image heating apparatus that causes the fixing sleeve 1 to generate heat with use of an eddy current. FIG. 18 illustrates cross-sections of main portions of the fixing apparatus A according to the fourth exemplary embodiment. In FIG. 18, the same reference numerals are assigned to the members and the portions that work in a similar manner to the first exemplary embodiment illustrated in FIG. 2, and members and portions that will not be described below are configured similar to the first exemplary embodiment. Further, FIG. 19 is a front view of the exciting coil 3 according to the fourth exemplary embodiment.

For the fixing sleeve 1 according to the fourth exemplary embodiment, ferromagnetic metal such as nickel, iron, ferromagnetic stainless steel (SUS), and a nickel-cobalt alloy is desirably used as the heat generation layer. Further, the heat generation layer desirably has a thickness of 1 to 100 μm in consideration of a relationship between efficiency of absorption of electromagnetic energy and the hardness of the film.

Figure 19:
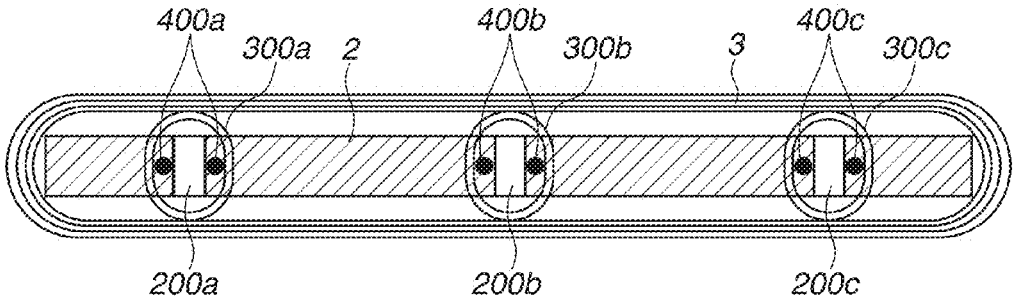
FIG. 19 is a front view of the fixing apparatus according to the fourth exemplary embodiment.

The magnetic core 2 has a T-shaped cross-section as illustrated in FIG. 18, and is divided into four pieces in the longitudinal direction in which division regions 200*a*, 200*b*, and 200*c* of the divided magnetic core 2 have an interval of 150 μm as illustrated in FIG. 19. The magnetic flux passing through the fixing sleeve 1 decreases at these division regions 200*a*, 200*b*, and 200*c*, which makes it difficult to generate heat with use of an eddy current, thereby leading to heat generation drops.

The exciting coil 3 according to the fourth exemplary embodiment is formed by bundling together a plurality of copper thin wires. Each thin wire is processed by insulation coating, and the bundled wires are wound around the magnetic core 2 a plurality of times as illustrated in FIGS. 18 and 19. The exciting coil 3 is connected to an exciting circuit. The exciting coil 3 is wound at the division regions 200*a*, 200*b*, and 200*c* a larger number of turns, just as windings 300*a*, 300*b*, and 300*c* illustrated in FIG. 19 which are a part of the exciting coil 3. These windings 300*a*, 300*b*, and 300*c* are wound around protrusions 400*a*, 400*b*, and 400*c* formed on the magnetic core 2, respectively.

As described above, the exciting coil 3 is wound a larger number of turns at the division regions 200*a*, 200*b*, and 200*c* of the magnetic core 2, which urges the heat generation of the fixing sleeve 1 with an eddy current at the division regions 200*a*, 200*b*, and 200*c*. Therefore, it is possible to reduce the heat generation drops.

According to the fourth exemplary embodiment, even if the division regions 200*a*, 200*b*, and 200*c* have intervals different from the above-described example, the heat generation drops can be reduced by adjusting the method of winding the exciting coil 3 in a similar manner. In the fourth exemplary embodiment, all of the division regions 200*a*, 200*b*, and 200*c* have the intervals of 150 μm. If the intervals are longer than that, this leads to expansion of the ranges having lower magnetic permeabilities, resulting in further decreases in the temperature of the fixing sleeve 1 where the heat generation drops occur. Therefore, if the division regions 200*a*, 200*b*, and 200*c* have intervals longer than 150 μm, it is possible to reduce the heat generation drops to prevent or decrease occurrence of an image defect, by further increasing the number of turns of the exciting coil 3 in the vicinities of the division regions 200*a*, 200*b*, and 200*c*, from the above-described example of the fourth exemplary embodiment.

Further, if the magnetic core 2 is configured similar to the example illustrated in FIG. 10 according to the first exemplary embodiment, that is, if not all of the division regions 200*a*, 200*b*, and 200*c* have equal intervals, the heat generation drops can be reduced by winding the exciting coil 3 a larger number of turns at a division region having a longest interval than at the other division regions.

As described above, even in the IH type fixing apparatus, the fourth exemplary embodiment can reduce the heat generation drops that occur at the division regions 200*a*, 200*b*, and 200*c* of the magnetic core 2, thereby preventing or reducing occurrence of an image defect such as a fixing defect.

An image forming apparatus according to a fifth exemplary embodiment is configured similar to the image forming apparatus 100 described in the first exemplary embodiment except for the fixing apparatus. Therefore, a description of the image forming apparatus will be omitted here. Further, a fixing apparatus according to the fifth exemplary embodiment is also similar to the first exemplary embodiment except for the features described in the first exemplary embodiment, and therefore a description thereof will be also omitted here.

Figure 28:
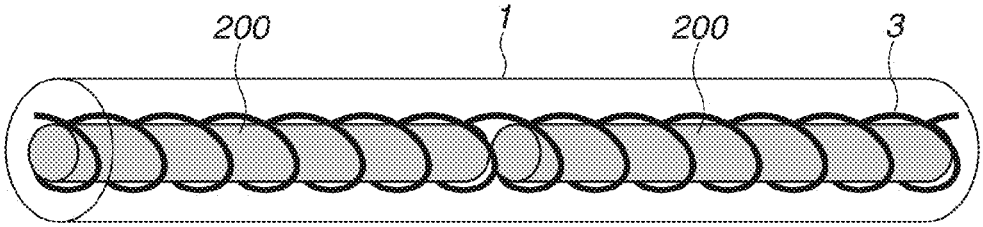
FIG. 28 is a perspective view of a fixing apparatus according to a fifth exemplary embodiment.

A magnetic core 200 according to the present exemplary embodiment will be described. FIG. 28 is a perspective view illustrating the fixing sleeve 1, the magnetic core 200, and the exciting coil 3 according to the present exemplary embodiment. The magnetic core 200 according to the present exemplary embodiment is a cylindrical magnetic core member having a diameter of 5 to 15 mm. The magnetic core 200 is divided into two pieces having substantially equal lengths in the generatrix direction of the fixing sleeve 1, and a division position between these divided cores (a position of a boundary between the divided cores) is arranged so as to be substantially coinciding with the central position of the fixing sleeve 1 in the generatrix direction thereof. In the present exemplary embodiment, the recording material P is conveyed based on the central position of the fixing sleeve 1 in the generatrix direction thereof, so that this division position of the magnetic core 2 is also substantially coinciding with a conveyance central position of the recording material P. The magnetic core 200 according the present exemplary embodiment is divided by a plane perpendicular to the generatrix direction of the fixing sleeve 1.

The magnetic core 200 is disposed in the hollow portion (the inside) of the fixing sleeve 1 with use of a not-illustrated fixing unit, and forms a magnetic path by guiding a line of magnetic force produced by the exciting coil 3 into the magnetic core 200. The exciting coil 3 is a single conductive wire, and is helically wound around the magnetic core 2. When a high-frequency current is supplied from the high-frequency converter (not illustrated) to this exciting coil 3, an alternating magnetic flux having cyclically reversing polarities is produced in the generatrix direction of the fixing sleeve 1, and a loop current (a current in the circumferential direction) flows around the conductive layer 1*a* of the fixing sleeve 1, by which the fixing sleeve 1 generates heat. A configuration of the magnetic core 200 will be described now. A magnetic core that includes divided cores more than two cores in the generatrix direction of the fixing sleeve 1 facilitates handling of the magnetic core, and facilitates cost cutting and inductance adjustment. The magnetic core may be configured such that the divided cores are directly adhered to each other with use of an adhesive, or a Mylar (registered trademark) sheet or the like is inserted between the divided cores.

However, in the above-described magnetic core, such a problem arises that a gap distance between the respective magnetic cores varies due to a variation in dimensional precision of the divided surfaces of the magnetic cores, unevenness of the thickness of the Mylar sheet, and the like. This leads to unevenness of heat generation between the left side and the right side, so that the heat generation distribution of the fixing sleeve 1 in the generatrix direction thereof becomes asymmetric between the left side and the right side.

Therefore, the magnetic core 200 according to the present exemplary embodiment is configured in such a manner that the divided cores, in which the magnetic core 200 is divided into two pieces having equal lengths, are adhered to each other with use of an adhesive. Further, the magnetic core 200 according to the present exemplar embodiment is configured in such a manner that the division position between the divided cores (the position of the boundary between the divided cores) is substantially coinciding with a central position of a region of the fixing sleeve 1 which the recording material P passes through (the central position of the fixing sleeve 1) with respect to the generatrix direction of the fixing sleeve 1.

Figure 29A:
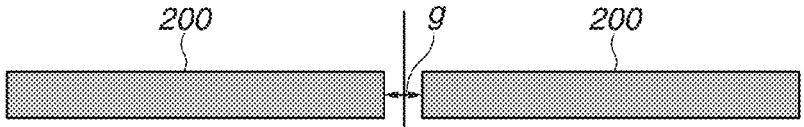
FIGS. 29A, 29B, and 29C illustrate an arrangement of magnetic cores in an axial direction according to the fifth exemplary embodiment and comparative examples.
Figure 29B:
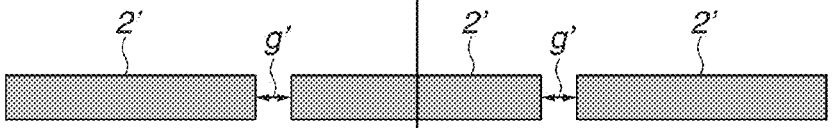
Figure 29C:
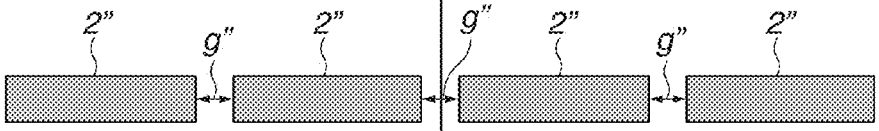

A comparison experiment for verifying an effect of the present exemplary embodiment was conducted. FIG. 29A illustrates a layout of the magnetic core 200 according to the present exemplary embodiment in the longitudinal direction. FIGS. 29B and 29C illustrate a layout of a magnetic core 2' evenly divided into three pieces and a layout of a magnetic core 2" evenly divided into four pieces, as comparative examples 3 and 4 in the longitudinal direction, respectively.

Any of these magnetic cores are configured in such a manner that the divided cores are fixed to each other with use of an adhesive. Assume that gap distances of gaps g, g', and g" in the respective present exemplary embodiment, comparative example 3, and comparative example 4 vary within a range of 20 μm to 40 μm depending on the dimensional precision of the divided surfaces of the divided cores.

A table 9 indicates a result of measurement of the surface temperature of the fixing sleeve 1 in the generatrix direction when the gap distance varies by a maximum amount with respect to each of the magnetic core configurations, to confirm the effect of the present exemplary embodiment.

A temperature difference between the left side and the right side of the fixing sleeve 1 indicated in the table 9 is a difference between temperatures at left and right positions located a distance of 105 mm away from the central position of the fixing sleeve 1, when power to be supplied to the fixing apparatus is controlled in such a manner that the temperature detected by the temperature detection member 9 is maintained at a target temperature (180° C.)

Figure 30:
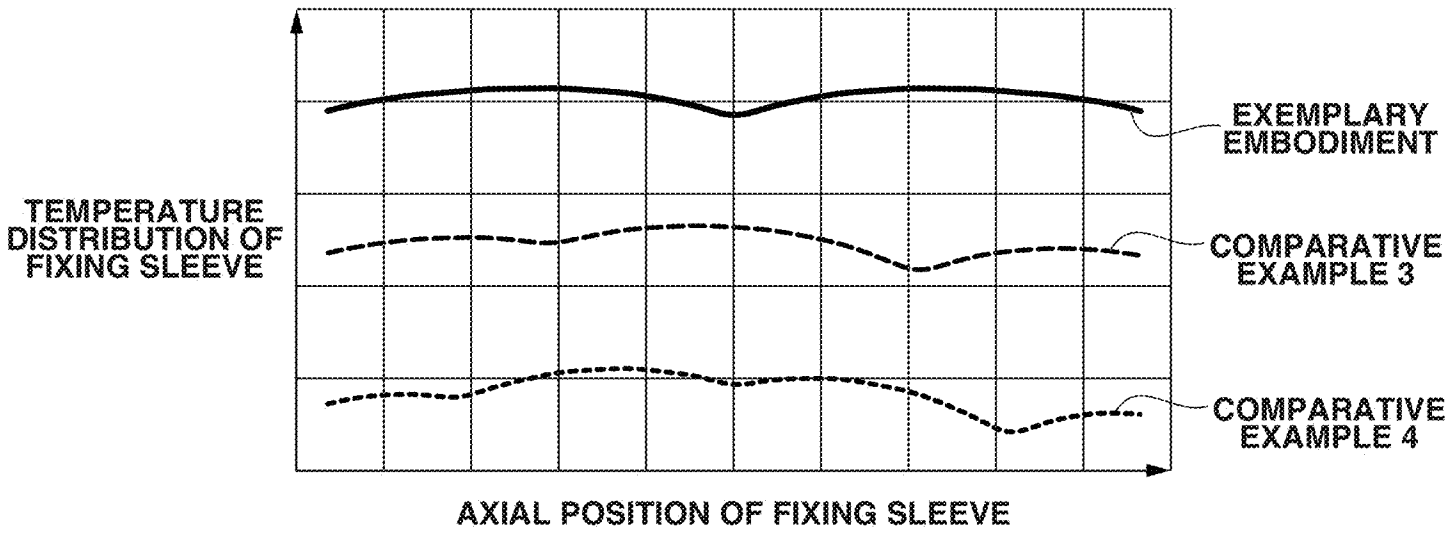
FIG. 30 illustrates temperature distributions of the fixing sleeve in a generatrix direction thereof according to the fifth exemplary embodiment and the comparative examples.

The surface temperature of the fixing sleeve 1 in the generatrix direction was measured with respect to each of the present exemplary embodiment, the comparative example 3, and the comparative example 4. The gap distance of the gap g according to the present exemplary embodiment illustrated in FIG. 29A is 40 μm. Further, gap distances of the two gaps g' according to the comparative example 3 illustrated in FIG. 29B are 20 μm and 40 μm, respectively. Further, gap distances of the gaps g" at the central portion and one of the end portions, between the three gaps g" according to the comparative example 4 illustrated in FIG. 29C, are 20 μm, and a gap distance of the gap g" at the remaining end portion is 40 μm. FIG. 30 illustrates the result of the measurement.

In FIG. 30, graphs of the respective temperatures are arranged to be lined up in a vertically offset manner to facilitate a comparison among them. From the illustration of FIG. 30, it can be confirmed that the temperature distribution of the fixing sleeve 1 is symmetric between the left side and the right side in the present exemplary embodiment, while the temperature distribution is asymmetric between the left side and the right side in both the comparative examples 3 and 4.

TABLE 9

| | NUMBER OF DIVISIONS | GAP AMOUNT | TEMPERATURE DIFFERENCE BETWEEN LEFT SIDE AND RIGHT SIDE OF FIXING SLEEVE |
|---|---|---|---|
| EXEMPLARY EMBODIMENT ILLUSTRATED IN FIG. 29A | 2 | 40 μm | 0° C. |
| COMPARATIVE EXAMPLE 3 ILLUSTRATED IN FIG. 29B | 3 | 20 μm 40 μm | 1° C. |
| COMPARATIVE EXAMPLE 4 ILLUSTRATED IN FIG. 29C | 4 | 20 μm 20 μm 40 μm | 2° C. |

More specifically, as indicated in the table 9, 0° C. was measured as the temperature difference between the left side and the right side of the fixing sleeve 1 in the magnetic core 200 divided into two pieces according to the present exemplary embodiment, while 1° C. and 2° C. were measured as the temperature differences between the left side and the right side in the magnetic core 2' divided into three pieces according to the comparative example 3 and the magnetic core 2" divided into four pieces according to the comparative example 4, respectively. From the result of this experiment, it can be seen that the configuration according to the present exemplary embodiment is effective in eliminating or reducing the temperature difference between the left side and the right side. In the present exemplary embodiment, the fixing sleeve 1 may be displaced by approximately 3 mm with respect to the magnetic core 200 in the generatrix direction of the fixing sleeve 1 due to tolerances of the components or the like. However, even when the central position of the fixing sleeve 1 is displaced by approximately 3 mm with respect to the position of the boundary between the divided cores, the effect of preventing or reducing the unevenness of heat generation between the left side and the right side can be achieved. Therefore, it is equivalent to the configuration in which the central position of the fixing sleeve 1 is coinciding with the position of the boundary between the divided cores. Further, the magnetic core 200 according to the present exemplary embodiment is evenly divided into two pieces in the generatrix direction of the fixing sleeve 1. However, a magnetic core including two divided cores having no more than a length difference caused by the tolerances of the components is equivalent to the magnetic core evenly divided into two pieces.

Figure 31:
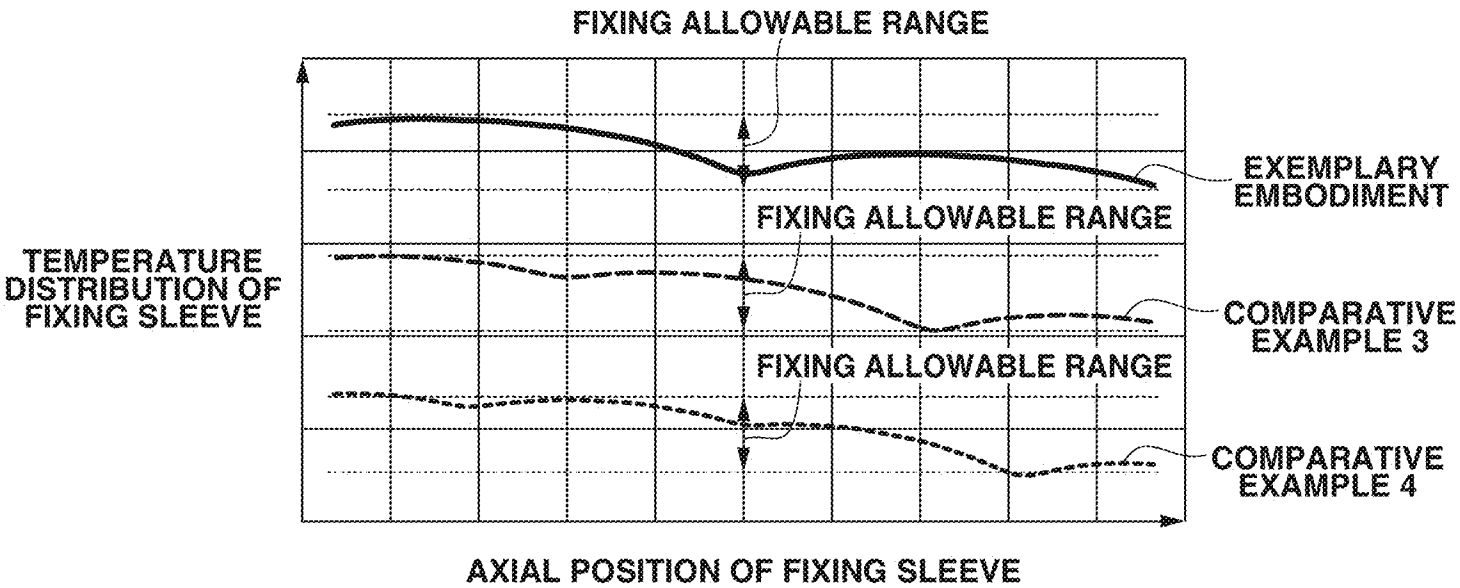
FIG. 31 illustrates temperature distributions of the fixing sleeve in the generatrix direction thereof according to the fifth exemplary embodiment and the comparative examples.

Next, the surface temperature of the fixing sleeve 1 was measured, with the fixing sleeve 1 displaced by 3 mm (a maximum distance in the range of the dimensional tolerance) with respect to the exciting coil 3 (the magnetic core 200) in the generatrix direction of the fixing sleeve 1 (in a direction for facilitating the unevenness of heat generation between the left side and the right side). FIG. 31 illustrates a result of the measurement. The temperature difference between the left side and the right side of the fixing sleeve 1 was 9° C. in the present exemplary embodiment, 10° C. in the comparative example 3, and 11° C. in the comparative example 4.

Although toner is used in which a temperature range free from an image defect is less than 10° C. in the present exemplary embodiment, an image defect does not occur in the magnetic core 200 divided into two pieces according to the present exemplary embodiment. However, the magnetic core 2' divided into three pieces according to the comparative example 3 and the magnetic core 2" divided into four pieces according to the comparative example 4 lead to occurrence of unevenness of fixability between the left side and the right side as an image defect.

Thus, according to the present exemplary embodiment, an effect of impeding occurrence of the unevenness of heat generation between the left side and the right side of the fixing sleeve 1 can be acquired, regardless of the gap distance of the magnetic core 200 (the interval between the divided cores). Further, according to the present exemplary embodiment, an effect of increasing a margin for displacement of the fixing sleeve 1 with respect to the magnetic core 200 in the generatrix direction of the fixing sleeve 1 can also be acquired.

The magnetic core 200 according to the present exemplary embodiment is configured in such a manner that the divided cores are adhered to each other with use of an adhesive, but does not have to be configured in this manner. The magnetic core 200 may be configured such that the Mylar (registered trademark) or the like is inserted between the divided cores. Further, the magnetic core 200 may be configured such that the divided cores are held at predetermined positions with use of a bobbin or the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image heating apparatus configured to heat an image formed on a recording material, the image heating apparatus comprising:

a cylindrical rotatable member including a conductive layer;

a coil including a helically shaped portion which is helically wound in a generatrix direction of the rotatable member inside the rotatable member, wherein the coil includes a number of turns and is configured to produce an alternating magnetic field for causing the conductive layer to generate heat by electromagnetic induction; and a magnetic core disposed inside the helically shaped portion, wherein the magnetic core includes a plurality of divided cores into which the magnetic core is divided in the generatrix direction, and wherein the number of turns of the coil per unit length, at a region that corresponds to a boundary between the plurality of divided cores, is larger than the number of turns of the coil at a region that corresponds to the plurality of divided cores.

2. The image heating apparatus according to claim 1, wherein the magnetic core is formed so as not to form a loop outside the rotatable member.

3. The image heating apparatus according to claim 2, wherein the rotatable member is heated by a current circumferentially flowing in the conductive layer.

4. The image heating apparatus according to claim 2, wherein a magnetic resistance of the magnetic core is twenty-eight percent or lower of a magnetic resistance that combines a magnetic resistance of the conductive layer with a magnetic resistance of a region between the conductive layer and the magnetic core, in a section from one end to the other end of a maximum region through which the image passes, with respect to the generatrix direction.

5. The image heating apparatus according to claim 1, wherein the magnetic core includes three or more divided cores, and the number of turns of the coil per unit length is larger at a region corresponding to a boundary where an interval between the plurality of divided cores is a first interval than at a region corresponding to a boundary where the interval is a second interval that is shorter than the first interval.

6. The image heating apparatus according to claim 1, wherein the rotatable member is a sleeve.

7. The image heating apparatus according to claim 1, wherein the conductive layer is made from a non-magnetic material.

8. The image heating apparatus according to claim 7, wherein the conductive layer is made from at least one of silver, aluminum, austenite stainless steel, and copper.

9. An image heating apparatus configured to heat an image formed on a recording material, the image heating apparatus comprising:

a cylindrical rotatable member including a conductive layer;

a coil including a helically shaped portion which is helically wound in a generatrix direction of the rotatable member inside the rotatable member, wherein the coil is configured to produce an alternating magnetic field for causing the conductive layer to generate heat by electromagnetic induction; and a magnetic core disposed inside the helically shaped portion, wherein the magnetic core is shaped so as not to form a loop outside the rotatable member, wherein the magnetic core consists of two divided cores which are arranged in the generatrix direction, and wherein the two divided cores are arranged such that a boundary between the two divided cores is positioned at an area where a center of the recording material in the generatrix direction passes.

10. The image heating apparatus according to claim 9, wherein the rotatable member is heated by a current circumferentially flowing in the conductive layer.

11. The image heating apparatus according to claim 9, wherein a magnetic resistance of the magnetic core is twenty-eight percent or lower of a magnetic resistance that combines a magnetic resistance of the conductive layer with a magnetic resistance of a region between the conductive layer and the magnetic core, in a section from one end to the other end of a maximum region through which the image passes, with respect to the generatrix direction.

12. The image heating apparatus according to claim 9, wherein the rotatable member is a sleeve.

13. The image heating apparatus according to claim 9, wherein the conductive layer is made from a non-magnetic material.

14. The image heating apparatus according to claim 13, wherein the conductive layer is made from at least one of silver, aluminum, austenite stainless steel, and copper.

15. The image heating apparatus according to claim 9, wherein the two divided cores are the same length.

* * * * *